US006727212B2

(12) United States Patent
Kasturi et al.

(10) Patent No.: US 6,727,212 B2
(45) **Date of Patent: *Apr. 27, 2004**

(54) METHOD FOR SOFTENING SOIL ON HARD SURFACES

(75) Inventors: Chandrika Kasturi, Cincinnati, OH (US); Kristen Lynne McKenzie, Mason, OH (US); William Michael Scheper, Lawrenceburg, IN (US); Peter Robert Foley, Cincinnati, OH (US)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/530,793

(22) PCT Filed: Nov. 6, 1998

(86) PCT No.: PCT/US98/23657

§ 371 (c)(1),
(2), (4) Date: May 4, 2000

(87) PCT Pub. No.: WO99/24539

PCT Pub. Date: May 20, 1999

(65) Prior Publication Data

US 2002/0039988 A1 Apr. 4, 2002

Related U.S. Application Data

(63) Continuation-in-part of application No. 08/989,550, filed on Dec. 12, 1997, now Pat. No. 6,069,122.
(60) Provisional application No. 60/065,006, filed on Nov. 10, 1997.

(51) Int. Cl.[7] ..... C11D 9/40
(52) U.S. Cl. ..... 510/220; 510/226; 510/235; 510/499
(58) Field of Search ..... 510/226, 218, 510/235, 499, 220

(56) References Cited

U.S. PATENT DOCUMENTS

| | | | | | |
|---|---|---|---|---|---|
| 2,267,205 | A | | 12/1941 | Kyrides | 252/152 |
| 3,003,970 | A | | 10/1961 | Call | 252/152 |
| 3,173,876 | A | | 3/1965 | Zobrist | 252/137 |
| 3,309,321 | A | | 3/1967 | McMaster | 252/152 |
| 3,839,234 | A | | 10/1974 | Roscoe | 252/544 |
| 3,860,525 | A | * | 1/1975 | Bechtold | 252/99 |
| 3,935,129 | A | | 1/1976 | Jabalee | 252/525 |
| 4,001,123 | A | | 1/1977 | Renold | 252/8.8 |
| 4,077,896 | A | | 3/1978 | Bunegar et al. | 252/90 |
| 4,547,301 | A | | 10/1985 | Ooms | 252/8.8 |
| 4,556,509 | A | | 12/1985 | Demangeon et al. | 252/542 |
| 5,158,612 | A | | 10/1992 | Savoly et al. | 106/678 |
| 5,484,555 | A | | 1/1996 | Schepers | 252/542 |
| 5,858,117 | A | * | 1/1999 | Oakes et al. | 134/27 |
| 5,861,366 | A | * | 1/1999 | Ihns et al. | 510/320 |
| 6,069,122 | A | | 5/2000 | Vinson et al. | 510/235 |

FOREIGN PATENT DOCUMENTS

| | | | | |
|---|---|---|---|---|
| EP | 232092 | * | 8/1987 | |
| EP | 0 232 092 | A | 8/1987 | C11D/3/30 |
| EP | 0 410 567 | A2 | 1/1991 | A61K/7/48 |
| EP | 0414581 | A1 | 2/1991 | C11D/3/39 |
| JP | 63131124 | A | 6/1988 | C11D/3/48 |
| WO | WO 95/19951 | A | 7/1995 | C07C/215/14 |
| WO | WO 96/16152 | * | 5/1996 | |
| WO | WO 97/32961 | * | 9/1997 | |
| WO | WO 97/35949 | * | 10/1997 | |

OTHER PUBLICATIONS

Derwent Publications Ltd., Database WPI, Week 9338, XP002061448 & JP 05 214 392 A, Aug. 24, 1993 (Abstract only).

* cited by examiner

*Primary Examiner*—John Hardee
(74) *Attorney, Agent, or Firm*—Thibault Fayette; C. Brant Cook; Ian S. Robinson

(57) ABSTRACT

The present application relates to a method of softening soil deposited on a hard surface. The method comprises contacting a hard surface having soil with a composition having a soil softening additive incorporated into the composition. The compositions may be formulated at either high or low pH and preferred soil softening additives are amylase enzymes.

14 Claims, No Drawings

METHOD FOR SOFTENING SOIL ON HARD SURFACES

CROSS-REFERENCE TO RELATED APPLICATION

This Application claims priority from U.S. application No. 60/065,006, filed Nov. 10, 1997, and is a continuation-in-part of U.S. application Ser. No. 08/989,550, filed Dec. 12, 1997, now U.S. Pat. No. 6,069,122, May 30, 2000.

FIELD OF THE INVENTION

The present application relates to a method of softening soil deposited on a hard surface.

BACKGROUND OF THE INVENTION

Typical commercial hard surface cleaners involve the application of the cleaner, or a dilute solution of the cleaner, to the soiled hard surface. Typically scrubbing is then required by the user, especially on tough soils such as burnt milk, caramelized sugars, cooked egg, soils which have hardened with time, etc. This is particularly true in the hand cleaning of tableware and pots and pans. It is not uncommon to have both light soils and heavy or tough soils on a variety of different surfaces, such as fine china plates, copper pots, stainless flatware, wooden spatulas, ceramic mortar and pestles, etc. in hand dish cleaning.

Accordingly, there remains the need for a way of removing both light and tough soils from hard surfaces which will not damage the hard surface, be laborious or require excess scrubbing by the consumer.

SUMMARY OF THE INVENTION

This need is met by way of the present invention where a method of softening soil on hard surfaces is provided. Specifically, the present invention comprises a method for softening soil on a hard surface, comprising contacting the hard surface, for a time sufficient to soften the soil with a soil softening amount of a composition comprising:

a high pH soil softening additive;

wherein the composition has a pH of greater than 8.5 to 12 and wherein further the composition has a Soil Softening Index of at least 15.

It is a further embodiment of the present invention, a method for softening soil on a hard surface, comprising contacting the hard surface for a time sufficient to soften the soil with a soil softening amount of a composition comprising:

a low pH soil softening additive;

wherein said composition has a pH of 6 to 8.5 and wherein further said composition has a Soil Removal of at least 20%.

It is a further embodiment of the invention that the high pH soil softening additive is selected from the group consisting of pH buffers, enzymes, solvents, builders, chelants, surfactants and mixtures thereof.

It is a further embodiment of the invention that the low pH soil softening additive is selected from the group consisting of enzymes, solvents, builders, chelants, surfactants and mixtures thereof.

Accordingly, it is an object of the present invention to provide a method of softening soils on hard surfaces. It is yet another object of the present invention to provide a method for softening soils via the use of a soil softening additive. These and other objects, features and advantages will be apparent from the following description and the appended claims.

All percentages, ratios and proportions herein are on a weight basis unless otherwise indicated. All documents cited herein are hereby incorporated by reference.

DETAILED DESCRIPTION OF THE INVENTION

The methods of softening soil on a hard surface according to the present invention will employ a high pH soil softening additive in a composition with a pH from greater than 8.5 to 12. Alternatively, the methods of softening soil on a hard surface according to the present invention will employ a low pH soil softening additive in a composition with a pH from 6 to 8.5. The essential and optional components of the soil softening method and other optional materials herein, as well as composition form and preparation, are described in greater detail as follows:

The present invention comprises a method for softening soil on a hard surface, comprising contacting the hard surface, for a time sufficient to soften the soil with a soil softening amount of a composition comprising a high pH soil softening additive; wherein the composition has a pH of greater than 8.5 to 12 and wherein further the composition has a Soil Softening Index (SSI) of at least 15.

The present invention also includes a method for softening soil on a hard surface, comprising contacting the hard surface, for a time sufficient to soften the soil with a soil softening amount of a composition comprising a low pH soil softening additive; wherein the composition has a pH of 6 to 8.5 and wherein further the composition has a Soil Removal (SR) of at least 20%.

A "soil softening amount" of a composition is an amount sufficient to achieve soil softening. The composition used in the present method to soften the soil can be used either in a dilute aqueous form or in concentrated or undiluted form. Preferably, a softening amount will be from 0.001% to 1%, more preferably from 0.004% to 0.5%, even more preferably from 0.01% to 0.2%, by weight when the composition is dilute. Preferably, when the composition is used neat, or concentrated, a softening amount will be from 1% to 100%, more preferably from 1% to 80%, even more preferably from 2% to 50%, even more preferably still from 2% to 10 by weight.

A "high pH" in the present application is any pH in the range from greater than 8.5 to 12. A "low pH" in the present application is any pH in the range from 6 to 8.5.

A "hard surface" is any surface which is traditionally regarded as hard, that is tableware, such as plates, glasses, cutlery, pots and pans, and also includes other surfaces such as kitchen counter tops, sinks, glass, windows, enamel surfaces, metal surfaces, tiles, bathtubs, floors etc. Preferably, the hard surfaces is tableware. Hard surfaces typically do not include fabrics, such as clothing or the like.

A "soil softening additive" in the present application can be a "high pH soil softening additive", namely pH buffers, enzymes, solvents, builders, chelants, surfactants and mixtures thereof. These "high pH soil softening additives" are used when the compositions used in the methods of the present invention have a "high pH, namely a pH from greater than 8.5 to 12. Alternatively, a "soil softening additive" in the present application can be a "low pH soil softening additive", namely enzymes, solvents, builders, chelants, surfactants and mixtures thereof. These "low pH soil softening additives" are used when the compositions used in the methods of the present invention have a "low pH, namely a pH from 6 to 8.5.

The time sufficient to soften the soil can vary greatly depending upon many factors including, but not limited to, temperature, water hardness, concentration, etc. Preferably the time sufficient to soften the soil is from 2 minutes to overnight, typically 12 hours, more preferably 5 minutes to 8 hours, even more preferably 7 minutes to 2 hours, even more preferably still 10 minutes to 30 minutes.

The compositions used in the methods of the present invention can be formulated in many different forms, including for example, hand dishwashing compositions (LDL), automatic dishwashing pretreaters, hardsurface cleaners, etc.

Soil Softening Index (SSI)

The Soil Softening Index or SSI, is a measure of how soft a soil is after treatment with a composition in comparison to the soil before treatment with the composition. This softening of the soil results in an increase in the thickness of the soil from the thickness of the soil before it was softened. It is believed, while not being limited by theory that the thickening is caused by the rehydration of the soil. The softening of the soil makes the soil easier to remove by subsequent application of force, e.g. wiping, rinsing, autodishwashing, etc., than if the soil had not been softened. The measuring of this change of soil thickness gives the SSI.

The soils softened according to the methods of the present invention have a SSI of at least 15%, preferably at least 20%, more preferably at least 30%.

The SSI is measured with a RM600 2-D/3-D Measuring Station made by Optische Werke G. Rodenstock Munich, Germany.

To determine if a composition is suitable for use in the inventive method the following steps are performed 1. Soils, as described hereinafter, are prepared on stainless steel, plastic, aluminum or glass coupons in such a way that half of the total area of the substrate is soiled.
2. The thickness of the soil is measured by using the arrangement described below.
3. Soiled coupons are soaked in the solution for 20 minutes at 46° C. and 7 gpg hardness.
4. The thickness of the soil is measured again using the arrangement described below.

The thickness is measured in the following fashion:

Each soiled coupon is aligned on the table of the measuring station so that the measuring surface is parallel to the movement direction of the traverse table. The slide and the sample are both fitted on a solid vibration-damped base plate. Then the sensor is adjusted manually until it is perpendicular to the measuring surface at the required distance.

The measuring procedure is controlled by the measuring program of the control computer. This program reads the measuring values supplied by the sensor (as analog signals) and stores them as numerical values. The numerical values obtained are $S_i$, or initial soil height and $S_f$ final soil height.

The SSI is calculated in the following fashion:

$$SSI = \frac{S_f - S_i}{S_i} \times 100$$

SR or Soil Removal

The SR or soil removal is a measure of how much soil is removed from a surface after the soil is softened according to the methods of the present invention. The soiled coupons, either metal or glass, are soiled, soaked then put in a dish washer, without additional detergent or rinse aid. The cleaned coupons are then dried and then weighed and the SR is a % determined by gravimetric analysis.

The soils softened according to the methods of the present invention have a SR of at least 20%, preferably at least 35%, more preferably at least 50%, even more preferably at least 65%.

In more specific detail the method involves the following steps:

1. A crystallization dish is filled with water with an artificial hardness of 7 gpg (grains per gallon) and a pH which is adjusted to 7.4. The water is then placed into a beaker on a hotplate/stirrer and a stir bar is added and set to 400 rpm. This water is then heated to 46° C. The soiled coupons to be used, which have been previously weighed and soiled according to the method described below, and then weighed again, are clipped to the beaker, making sure that the coupons are totally immersed in water. After 20 minutes the coupons are removed and rinsed three times under tap water at a flow rate of 1L per 10 seconds. The coupons are then clipped to a plexiglass holder, and then placed into the center of an ADW Asko mini-washer and rinsed at 45° C. for 5 minutes. After the rinse, the coupons are dried under a fume hood overnight and weight next morning. The percentage of soil removal, SR, is then determined by gravimetric analysis. That is SR is $$SR = \frac{SW_f - SW_i}{SW_i} \times 100$$

Wherein

SR is percentage of soil removal, $SW_f$ is the final weight of a soiled coupon; and $SW_i$ is the initial weight of the soiled coupon.

Soil Preparation

The metal or glass coupons used in determining either the SSI or SR of a composition used in the inventive methods are soiled with a standard soil or a standard egg soil. These soils are prepared in the following fashion.

Starch soil:

Tap water is boiled and a pinch of salt is added. 50 g spaghetti is placed into the boiling water. After this has boiled for a few minutes the water is drained. The spaghetti is blended with about 450 ml of tap water in a blender, until the spaghetti has a paste like consistency. The pasta mixture is cooked in water bath for about 2 hours. The pasta mixture is then poured into a 150 ml beaker and filled to the 120 ml line. A glass coupon of 7.6 cm×2.6 cm (76 mm×26 mm) is dipped into the pasta mixture; for 5 seconds. The back of the coupon is then wiped. After every 4 coupons the beaker is refilled to the 120 ml. The coupons are then baked in an oven.

Egg Soil:

The yolks are separated from some eggs and are strained through a colander. The yolks are then cooked for 30 minutes. The yolks are then left to cool to room temperature. The egg yolk mixture is then poured into a 150 ml beaker and filled to the 120 ml line. A metal coupon of 7.6 cm×2.6 cm (76 mm×26 mm) is dipped into the egg yolk mixture; for 10 seconds. The back of the coupon is then wiped. After every 4 coupons the beaker is refilled to the 120 ml. The soiled coupons are left to stand at room temperature for 2 hours. The coupons can then be baked in an oven for one and a half hours if an even tougher egg soil is desired.

The compositions used in the present methods can contact the soil and hard surface in many ways, but it is preferred that the soil and the hard surface which the soil is deposited on be partially or totally immersed in said composition.

The compositions used in the methods of the present invention will provide either a low pH or a high pH. By "low pH" it is meant that a 10% aqueous solution will have a pH of from 6 to 8.5. By "high pH" it is meant that a 10% aqueous solution will have a pH of from greater than 8.5 to 12. More preferably, the high pH compositions herein will have a 10% aqueous solution pH of from 9.5 to 11.5.

Soil Softening Additives:

The compositions for use in the methods of the present invention include a soil softening additive, either a high pH soil softening additive or a low pH soil softening additive. These soil softening additive will be preferably present in the composition used in the methods in amounts of from 0.001% to 99.9%, more preferably from 0.01% to 75%, even more preferably 0.1% to about 50%, by weight.

The high pH soil softening additive is selected from the group comprising pH buffers, enzymes, solvents, builders, chelants, surfactants and mixtures thereof.

The low pH soil softening additive is selected from the group comprising enzymes, solvents, builders, chelants, surfactants and mixtures thereof.

Enzyme

The soil softening methods of the present invention may preferably comprise one or more enzymes. Enzymes included may be selected from cellulases, hemicellulases, peroxidases, proteases, gluco-amylases, amylases, lipases, cutinases, pectinases, xylanases, reductases, oxidases, phenoloxidases, lipoxygenases, ligninases, pullulanases, tannases, pentosanases, malanases, β-glucanases, arabinosidases or mixtures thereof. One preferred combination is a method using a cocktail of conventional applicable enzymes like protease, amylase, lipase, cutinase and/or cellulase. Another preferred combination is that of two or more enzymes within a type of enzyme, for example a combination of two or more proteases. Preferably the amount of enzyme in the compositions used, when present, in the present methods are from 0.00001% to 5%, more preferably from 0.0001% to 2%, even more preferably 0.0005% to 1%, even more preferably still from 0.001% to 0.5%, even more preferably still from 0.001% to 0.1%.

Cellulases—the cellulases usable in the present invention include both bacterial or fungal cellulase. Suitable cellulases are disclosed in U.S. Pat. No. 4,435,307, Barbesgoard et al, which discloses fungal cellulase produced from *Humicola insolens*. Suitable cellulases are also disclosed in GB-A-2.075.028; GB-A-2.095.275 and DE-OS-2.247.832.

Examples of such cellulases are cellulases produced by a strain of *Humicola insolens* (*Humicola grisea* var. *thermoidea*), particularly the Humicola strain DSM 1800. Other suitable cellulases are cellulases originated from *Humicola insolens* having a molecular weight of 50 KDa, an isoelectric point of 5.5 and containing 415 amino acids. Especially suitable cellulases are the cellulases having color care benefits. Examples of such cellulases are cellulases described in European patent application No. 91202879.2, filed Nov. 6, 1991 (Novo).

Peroxidase enzymes are used in combination with oxygen sources, e.g. percarbonate, perborate, persulfate, hydrogen peroxide, etc. They are used for "solution bleaching", i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813 and in European Patent application EP No. 91202882.6, filed on Nov. 6, 1991.

Said cellulases and/or peroxidases, when used, are normally incorporated in the compositions for use in the inventive methods at levels from 0.0001% to 2% of active enzyme by weight of the composition.

Proteolytic Enzyme—The proteolytic enzyme can be of animal, vegetable or microorganism (preferred) origin. The proteases suitable for use in the methods herein include (but are not limited to) trypsin, subtilisin, chymotrypsin and elastase-type proteases. Preferred for use herein are subtilisin-type proteolytic enzymes. Particularly preferred is bacterial serine proteolytic enzyme obtained from *Bacillus subtilis* and/or *Bacillus licheniformis*.

Suitable proteolytic enzymes include Novo Industri A/S Alcalase® (preferred), Esperase®, Savinase® (Copenhagen, Denmark), Gist-brocades' Maxatase®, Maxacal® and Maxapem 15® (protein engineered Maxacal®) (Delft, Netherlands), and subtilisin BPN and BPN' (preferred), which are commercially available. Preferred proteolytic enzymes are also modified bacterial serine proteases, such as those made by Genencor International, Inc. (San Francisco, Calif.) which are described in European Patent 251,446B, granted Dec. 28, 1994 (particularly pages 17, 24 and 98) and which are also called herein "Protease B". U.S. Pat. No. 5,030,378, Venegas, issued Jul. 9, 1991, refers to a modified bacterial serine proteolytic enzyme (Genencor International) which is called "Protease A" herein (same as BPN'). In particular see columns 2 and 3 of U.S. Pat. No. 5,030,378 for a complete description, including amino sequence, of Protease A and its variants. Other proteases are sold under the tradenames: Primase, Durazym, Opticlean and Optimase. Preferred proteolytic enzymes, then, are selected from the group consisting of Alcalase® (Novo Industri A/S), BPN', Protease A and Protease B (Genencor), and mixtures thereof. Protease B is most preferred.

Of particular interest for use herein are the proteases described in U.S. Pat. No. 5,470,733.

Also proteases described in our co-pending application U.S. Ser. No. 08/136,797 can be included in the methods of the invention.

Another preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in WO 95/10615 published Apr. 20, 1995 by Genencor International (A. Baeck et al. entitled "Protease-Containing Cleaning Compositions" having U.S. Ser. No. 08/322,676, filed Oct. 13, 1994).

Useful proteases are also described in PCT publications: WO 95/30010 published Nov. 9, 1995 by The Procter & Gamble Company; WO 95/30011 published Nov. 9, 1995 by The Procter & Gamble Company; WO 95/29979 published Nov. 9, 1995 by The Procter & Gamble Company.

Protease enzyme may optionally be incorporated into the compositions for use in accordance with the methods of the invention at a level of from 0.0001% to 2% active enzyme by weight of the composition.

Lipase—suitable lipase enzymes include those produced by microorganisms of the Pseudomonas group, such as *Pseudomonas stutzeri* ATCC 19.154, as disclosed in British Patent 1,372,034. Suitable lipases include those which show a positive immunological cross-reaction with the antibody of the lipase, produced by the microorganism *Pseudomonas*

*fluorescens* IAM 1057. This lipase is available from Amano Pharmaceutical Co. Ltd., Nagoya, Japan, under the trade name Lipase P "Amano," hereinafter referred to as "Amano-P". Further suitable lipases are lipases such as M1 Lipase® and Lipomax® (Gist-Brocades). Other suitable commercial lipases include Amano-CES, lipases ex *Chromobacter viscosum,* e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli.* LIPOLASE® enzyme derived from *Humicola lanuginosa* and commercially available from Novo, see also EP 341,947, is a preferred lipase for use herein. Lipase and amylase variants stabilized against peroxidase enzymes are described in WO 9414951 A to Novo. See also WO 9205249 and RD 94359044.

Highly preferred lipases are the D96L lipolytic enzyme variant of the native lipase derived from *Humicola lanuginosa* as described in U.S. Ser. No. 08/341,826. (See also patent application WO 92/05249 viz. wherein the native lipase ex *Humicola lanuginosa* aspartic acid (D) residue at position 96 is changed to Leucine (L). According to this nomenclature said substitution of aspartic acid to Leucine in position 96 is shown as: D96L.) Preferably the *Humicola lanuginosa* strain DSM 4106 is used.

In spite of the large number of publications on lipase enzymes, only the lipase derived from *Humicola lanuginosa* and produced in *Aspergillus oryzae* as host has so far found widespread application as additive for washing products. It is available from Novo Nordisk under the tradename Lipolase® and Lipolase Ultra®, as noted above. In order to optimize the stain removal performance of Lipolase, Novo Nordisk have made a number of variants. As described in WO 92/05249, the D96L variant of the native *Humicola lanuginosa* lipase improves the lard stain removal efficiency by a factor 4.4 over the wild-type lipase (enzymes compared in an amount ranging from 0.075 to 2.5 mg protein per liter). Research Disclosure No. 35944 published on Mar. 10, 1994, by Novo Nordisk discloses that the lipase variant (D96L) may be added in an amount corresponding to 0.001–100-mg (5–500,000 LU/liter) lipase variant per liter of wash liquor.

Also suitable are cutinases [EC 3.1.1.50] which can be considered as a special kind of lipase, namely lipases which do not require interfacial activation. Addition of cutinases to detergent compositions have been described in e.g. WO-A-88/09367 (Genencor).

The lipases and/or cutinases are normally incorporated in the composition for use in the inventive methods at levels from 0.0001% to 2% of active enzyme by weight of the composition.

Amylase—Amylases (α and/or β) can be included for removal of carbohydrate-based stains. Suitable amylases are Termamyl® (Novo Nordisk), Fungamyl® and BAN® (Novo Nordisk). The enzymes may be of any suitable origin, such as vegetable, animal, bacterial, fungal and yeast origin. Amylase enzymes are, when present, normally incorporated in the compositions for use in the present inventive methods at levels from 0.0001% to 2% of active enzyme by weight of the detergent composition.

Amylase enzymes also include those described in WO95/26397 and in co-pending application by Novo Nordisk PCT/DK96/00056. Other specific amylase enzymes for use in the methods of the present invention therefore include:

(a) α-amylases characterized by having a specific activity at least 25% higher than the specific activity of Termamyl® at a temperature range of 25° C. to 55° C. and at a pH value in the range of 8 to 10, measured by the Phadebas® α-amylase activity assay. Such Phadebas® α-amylase activity assay is described at pages 9–10, WO95/26397.

(b) α-amylases according (a) comprising the amino sequence shown in the SEQ ID listings in the above cited reference. or an α-amylase being at least 80% homologous with the amino acid sequence shown in the SEQ ID listing.

(c) α-amylases according (a) obtained from an alkalophilic Bacillus species, comprising the following amino sequence in the N-terminal: His-His-Asn-Gly-Thr-Asn-Gly-Thr-Met-Met-Gln-Tyr-Phe-Glu-Trp-Tyr-Leu-Pro-Asn-Asp.

A polypeptide is considered to be X% homologous to the parent amylase if a comparison of the respective amino acid sequences, performed via algorithms, such as the one described by Lipman and Pearson in Science 227, 1985, p. 1435, reveals an identity of X%

(d) α-amylases according (a–c) wherein the α-amylase is obtainable from an alkalophilic Bacillus species; and in particular, from any of the strains NCIB 12289, NCIB 12512, NCIB 12513 and DSM 935.

In the context of the present invention, the term "obtainable from" is intended not only to indicate an amylase produced by a Bacillus strain but also an amylase encoded by a DNA sequence isolated from such a Bacillus strain and produced in an host organism transformed with said DNA sequence.

(e) α-amylase showing positive immunological cross-reactivity with antibodies raised against an α-amylase having an amino acid sequence corresponding respectively to those α-amylases in (a–d).

(f) Variants of the following parent α-amylases which (i) have one of the amino acid sequences shown in corresponding respectively to those α-amylases in (a–e), or (ii) displays at least 80% homology with one or more of said amino acid sequences, and/or displays immunological cross-reactivity with an antibody raised against an α-amylase having one of said amino acid sequences, and/or is encoded by a DNA sequence which hybridizes with the same probe as a DNA sequence encoding an α-amylase having one of said amino acid sequence; in which variants:

1. at least one amino acid residue of said parent α-amylase has been deleted; and/or
2. at least one amino acid residue of said parent α-amylase has been replaced by a different amino acid residue; and/or
3. at least one amino acid residue has been inserted relative to said parent α-amylase; said variant having an α-amylase activity and exhibiting at least one of the following properties relative to said parent α-amylase: increased thermostability, increased stability towards oxidation, reduced Ca ion dependency, increased stability and/or α-amylolytic activity at neutral to relatively high pH values, increased α-amylolytic activity at relatively high temperature and increase or decrease of the isoelectric point (pI) so as to better match the pI value for α-amylase variant to the pH of the medium.

Said variants are described in the patent application PCT/DK96/00056.

Other amylases suitable herein include, for example, α-amylases described in GB 1,296,839 to Novo; RAPIDASE®, International Bio-Synthetics, Inc. and TERMAMYL®, Novo. FUNGAMYL® from Novo is especially useful. Engineering of enzymes for improved stability, e.g., oxidative stability, is known. See, for example J. Biological Chem., Vol. 260, No. 11, June 1985, pp. 6518–6521. Certain preferred embodiments of the present methods can make use of amylases having improved stability in compositions such as automatic dishwashing types, especially improved oxidative stability as measured against a reference-point of TERMAMYL® in commercial use in 1993. These preferred amylases herein share the characteristic of being "stability-enhanced" amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as 60° C.; or alkaline stability, e.g., at a pH from 8 to 11, measured versus the above-identified reference-point amylase. Stability can be measured using any of the art-disclosed technical tests. See, for example, references disclosed in WO 9402597. Stability-enhanced amylases can be obtained from Novo or from Genencor International. One class of highly preferred amylases herein have the commonality of being derived using site-directed mutagenesis from one or more of the Bacillus amylases, especially the Bacillus α-amylases, regardless of whether one, two or multiple amylase strains are the immediate precursors. Oxidative stability-enhanced amylases vs. the above-identified reference amylase are preferred for use, especially in bleaching, more preferably oxygen bleaching, as distinct from chlorine bleaching, compositions herein. Such preferred amylases include (a) an amylase according to the hereinbefore incorporated WO 9402597, Novo, Feb. 3, 1994, as further illustrated by a mutant in which substitution is made, using alanine or threonine, preferably threonine, of the methionine residue located in position 197 of the *B. licheniformis* alpha-amylase, known as TERMAMYL®, or the homologous position variation of a similar parent amylase, such as *B. amyloliquefaciens, B. subtilis,* or *B. stearothermophilus;* (b) stability-enhanced amylases as described by Genencor International in a paper entitled "Oxidatively Resistant alpha-Amylases" presented at the 207th American Chemical Society National Meeting, Mar. 13–17 1994, by C. Mitchinson. Therein it was noted that bleaches in automatic dishwashing detergents inactivate alpha-amylases but that improved oxidative stability amylases have been made by Genencor from *B. licheniformis* NCIB8061. Methionine (Met) was identified as the most likely residue to be modified. Met was substituted, one at a time, in positions 8, 15, 197, 256, 304, 366 and 438 leading to specific mutants, particularly important being M197L and M197T with the M197T variant being the most stable expressed variant. Stability was measured in CASCADE® and SUNLIGHT®; (c) particularly preferred amylases herein include amylase variants having additional modification in the immediate parent as described in WO 9510603 A and are available from the assignee, Novo, as DURAMYL®. Other particularly preferred oxidative stability enhanced amylase include those described in WO 9418314 to Genencor International and WO 9402597 to Novo. Any other oxidative stability-enhanced amylase can be used, for example as derived by site-directed mutagenesis from known chimeric, hybrid or simple mutant parent forms of available amylases. Other preferred enzyme modifications are accessible. See WO 9509909 A to Novo.

Enzyme Stabilizing System—The enzymes used in the methods herein may optionally also comprise from 0.001% to 10%, preferably from 0.005% to 8%, most preferably from 0.01% to 6%, by weight of an enzyme stabilizing system. The enzyme stabilizing system can be any stabilizing system which is compatible with the enzyme. Such a system may be inherently provided by other formulation actives, or be added separately, e.g., by the formulator or by a manufacturer of enzymes. Such stabilizing systems can, for example, comprise calcium ion, boric acid, propylene glycol, short chain carboxylic acids, boronic acids, and mixtures thereof, and are designed to address different stabilization problems depending on the type and physical form of the composition or the method to which the composition is used in.

One stabilizing approach is the use of water-soluble sources of calcium and/or magnesium ions in the finished compositions which provide such ions to the enzymes. Calcium ions are generally more effective than magnesium ions and are preferred herein if only one type of cation is being used. Typical compositions, especially liquids, will comprise from 1 to 30, preferably from 2 to 20, more preferably from 8 to 12 millimoles of calcium ion per liter of finished composition, though variation is possible depending on factors including the multiplicity, type and levels of enzymes incorporated. Preferably water-soluble calcium or magnesium salts are employed, including for example calcium chloride, calcium hydroxide, calcium formate, calcium malate, calcium maleate, calcium hydroxide and calcium acetate; more generally, calcium sulfate or magnesium salts corresponding to the exemplified calcium salts may be used. Further increased levels of calcium and/or magnesium may of course be useful, for example for promoting the grease-cutting action of certain types of surfactant.

Another stabilizing approach is by use of borate species. See Severson, U.S. Pat. No. 4,537,706. Borate stabilizers, when used, may be at levels of up to 10% or more of the composition though more typically, levels of up to 3% by weight of boric acid or other borate compounds such as borax or orthoborate are suitable for liquid detergent use. Substituted boric acids such as phenylboronic acid, butaneboronic acid, p-bromophenylboronic acid or the like can be used in place of boric acid and reduced levels of total boron in compositions may be possible though the use of such substituted boron derivatives.

The enzymes can also be stabilized through the inclusion of propylene glycol or low molecular weigh polyethylene glycols (PEG), including dimers and trimers. These can be either mixed with the enzyme prior to addition to the compositions used herein, or they can be added directly to the compositions used herein either before or after the enzyme is added.

The enzyme can also be in the form of a prill to provide stability in storage. The prill can be made in the conventional manner, either by the formulator or in pre-made prill from the enzyme supplier. The prill can be any conventionally known prills.

Stabilizing systems of certain compositions, for example light duty liquid detergent compositions, may further comprise from 0 to 10%, preferably from 0.01% to 6% by weight, of chlorine bleach scavengers, added to prevent chlorine bleach species present in many water supplies from attacking and inactivating the enzymes, especially under alkaline conditions. While chlorine levels in water may be small, typically in the range from 0.5 ppm to 1.75 ppm, the available chlorine in the total volume of water that comes in contact with the enzyme, for example during dish-washing, can be relatively large; accordingly, enzyme stability to chlorine in-use is sometimes problematic. Since perborate or percarbonate, which have the ability to react with chlorine bleach, may be present in certain of the instant compositions in amounts accounted for separately from the stabilizing system, the use of additional stabilizers against chlorine, may, most generally, not be essential, though improved results may be obtainable from their use. Suitable chlorine scavenger anions are widely known and readily available, and, if used, can be salts containing ammonium cations with sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Likewise, special enzyme inhibition systems can be incorporated such that different enzymes have maximum compatibility. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartrate, salicylate, etc., and mixtures thereof can be used if desired. In general, since the chlorine scavenger function can be performed by ingredients separately listed under better recognized functions, (e.g., hydrogen peroxide sources), there is no absolute requirement to add a separate chlorine scavenger even if a compound performing that function to the desired extent is absent from the invention; even then, the scavenger is added only for optimum results. Moreover, the formulator will exercise a chemist's normal skill in avoiding the use of any enzyme scavenger or stabilizer which is majorly incompatible, as formulated, with other reactive ingredients. In relation to the use of ammonium salts, such salts can be simply mixed with the composition but are prone to adsorb water and/or liberate ammonia during storage.

pH Buffer

The high pH soil softening methods of the present invention may preferably comprise one or more pH buffers. The compositions used in the methods of the invention will be subjected to acidic stresses created by food soils when put to use, i.e., diluted and applied to soiled hard surfaces. The pKa value of the buffering agent used in the methods of the present invention should preferably be from 7 to 12, more preferably from 8 to 10.5, even more preferably from 8.5 to 10. Under these conditions the buffering agent most effectively controls the pH while using the least amount thereof.

The buffering agent, preferably, when present in the compositions used in the methods of the invention herein, at a level of from 0.1% to 15%, more preferably from 1% to 10%, even more preferably from 2% to 8%, by weight of the composition.

The buffering agent may be an active detergent in its own right, or it may be a low molecular weight, organic or inorganic material that is used in this composition solely for maintaining an alkaline pH. Preferred buffering agents for compositions of this invention are nitrogen-containing materials. Some examples are amino acids such as lysine or lower alcohol amines like mono-, di-, and tri-ethanolamine. Other preferred nitrogen-containing buffering agents are Tris (hydroxymethyl)amino methane $(HOCH_2)_3CNH_3$ (TRIS), 2-amino-2-ethyl-1,3-propanediol, 2-amino-2-methyl-propanol, 2-amino-2-methyl-1,3-propanol, disodium glutamate, N-methyl diethanolamide, 1,3-diamino-propanol N,N'-tetra-methyl-1,3-diamino-2-propanol, N,N-bis(2-hydroxyethyl)glycine (bicine) and N-tris (hydroxymethyl) methyl glycine (tricine). Mixtures of any of the above are also acceptable. Useful inorganic buffers/alkalinity sources include the alkali metal carbonates and alkali metal phosphates, e.g., sodium carbonate, sodium polyphosphate. For additional buffers see McCutcheon's EMULSIFIERS AND DETERGENTS, North American Edition, 1997, McCutcheon Division, MC Publishing Company Kirk and WO 95/07971 both of which are incorporated herein by reference.

An especially preferred buffering agent are the class of materials known as organic diamines. Preferred organic diamines are those in which pK1 and pK2 are in the range of 8.0 to 11.5, preferably in the range of 8.4 to 11, even more preferably from 8.6 to 10.75. Preferred materials for performance and supply considerations are 1,3 propane diamine (pK1=10.5; pK2=8.8), 1,6 hexane diamine (pK1=11; pK2=10), 1,3 pentane diamine (Dytek EP) (pK1=10.5; pK2=8.9), 2-methyl 1,5 pentane diamine (Dytek A) (pK1=1.2; pK2=10.0). Other preferred materials are the primary/primary diamines with alkylene spacers ranging from C4 to C8. In general, it is believed that primary diamines are preferred over secondary and tertiary diamines.

Definition of pK1 and pK2

As used herein, "pK1" and "pK2" are quantities of a type collectively known to those skilled in the art as "pKa" pKa is used herein in the same manner as is commonly known to people skilled in the art of chemistry. Values referenced herein can be obtained from literature, such as from "Critical Stability Constants: Volume 2, Amines" by Smith and Martel, Plenum Press, N.Y. and London, 1975. Additional information on pKa's can be obtained from relevant company literature, such as information supplied by Dupont, a supplier of diamines.

As a working definition herein, the pKa of the diamines is specified in an all-aqueous solution at 25° C. and for an ionic strength between 0.1 to 0.5 M. The pKa is an equilibrium constant which can change with temperature and ionic strength; thus, values reported in the literature are sometimes not in agreement depending on the measurement method and conditions. To eliminate ambiguity, the relevant conditions and/or references used for pKa's of this invention are as defined herein or in "Critical Stability Constants: Volume 2, Amines". One typical method of measurement is the potentiometric titration of the acid with sodium hydroxide and determination of the pKa by suitable methods as described and referenced in "The Chemist's Ready Reference Handbook" by Shugar and Dean, McGraw Hill, N.Y., 1990.

It has been determined that substituents and structural modifications that lower pK1 and pK2 to below 8.0 are undesirable and cause losses in performance. This can include substitutions that lead to ethoxylated diamines, hydroxy ethyl substituted diamines, diamines with oxygen in the beta (and less so gamma) position to the nitrogen in the spacer group (e.g., Jeffamine EDR 148). In addition, materials based on ethylene diamine are unsuitable.

The diamines useful herein can be defined by the following structure:

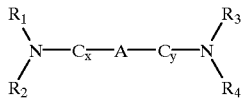

wherein $R_{1-4}$ are independently selected from H, methyl, —$CH_3CH_2$, and ethylene oxides; $C_x$ and $C_y$ are independently selected from methylene groups or branched alkyl groups where x+y is from 3 to 6; and A is optionally present and is selected from electron donating or withdrawing moieties chosen to adjust the diamine pKa's to the desired range. If A is present, then x and y must both be 1 or greater.

Examples of preferred diamines include the following:
Dimethyl aminopropyl amine:

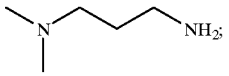

1,6-Hexane Diamine:

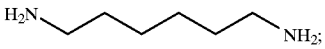

1,3-propane diamine—

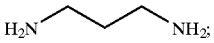

2-methyl 1,5 pentane diamine—

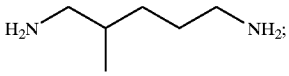

1,3-pentanediamine, available under the tradename Dytek EP

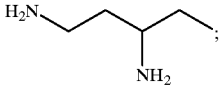

1-methyl-diaminopropane—

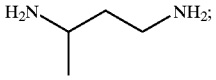

Jeffamine EDR 148—

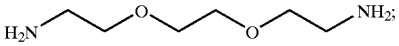

Isophorone diamine—

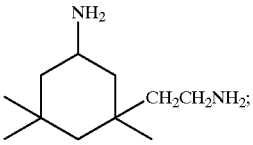

1,3-bis(methylamine)-cyclohexane

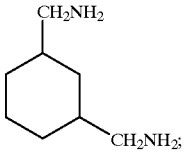

and mixtures thereof.

Preferably, when used the diamines used herein are pure or free of impurities. By "pure" is meant that the diamines are over 97% pure, i.e., preferably 98%, more preferably 99%, still more preferably 99.5%, free of impurities. Examples of impurities which may be present in commercially supplied diamines include 2-Methyl-1,3-diaminobutane and alkylhydropyrimidine. Further it is believed that the diamines should be free of oxidation reactants to avoid diamine degradation and ammonia formation. Additionally, if amine oxide and/or other surfactants are present, the amine oxide or surfactant should be hydrogen peroxide-free. The preferred level of hydrogen peroxide in the amine oxide or surfactant paste of amine oxide is 0–40 ppm, more preferably 0–15 ppm. Amine impurities in amine oxide and betaines, if present, should be minimized to the levels referred above for hydrogen peroxide. The compositions herein may additionally contain anti-oxidants to prevent ammonium formation upon aging due to oxygen uptake from air followed by diamine oxidation.

Solvents.

Optionally, the compositions of the present invention may further comprise one or more solvents. These solvents may be used in conjunction with an aqueous liquid carrier or they may be used without any aqueous liquid carrier being present. Solvents are broadly defined as compounds that are liquid at temperatures of 20° C.–25° C. and which are not considered to be surfactants. One of the distinguishing features is that solvents tend to exist as discrete entities rather than as broad mixtures of compounds. Some solvents which are useful in the hard surface cleaning compositions of the present invention contain from 1 carbon atom to 35 carbon atoms, and contain contiguous linear, branched or cyclic hydrocarbon moieties of no more than 8 carbon atoms. Examples of suitable solvents for the present invention include, methanol, ethanol, propanol, isopropanol, 2-methyl pyrrolidinone, benzyl alcohol and morpholine n-oxide. Preferred among these solvents are methanol and isopropanol.

The compositions used herein may optionally contain an alcohol having a hydrocarbon chain comprising 8 to 18 carbon atoms, preferably 12 to 16. The hydrocarbon chain can be branched or linear, and can be mono, di or polyalcohols. The compositions used herein can optionally comprise from 0.1% to 3% by weight of the total composition of such alcohol, or mixtures thereof, preferably from 0.1% to 1%.

The solvents which can be used herein include all those known to the those skilled in the art of hard-surfaces cleaner compositions. Suitable solvents for use herein include ethers and diethers having from 4 to 14 carbon atoms, preferably from 6 to 12 carbon atoms, and more preferably from 8 to 10 carbon atoms. Also other suitable solvents are glycols or alkoxylated glycols, alkoxylated aromatic alcohols, aromatic alcohols, aliphatic branched alcohols, alkoxylated aliphatic branched alcohols, alkoxylated linear C1–C5 alcohols, linear C1–C5 alcohols, C8–C14 alkyl and cycloalkyl hydrocarbons and halohydrocarbons, C6–C16 glycol ethers and mixtures thereof.

Suitable glycols which can be used herein are according to the formula HO—CR1R2-OH wherein R1 and R2 are independently H or a C2–C10 saturated or unsaturated aliphatic hydrocarbon chain and/or cyclic. Suitable glycols to be used herein are dodecaneglycol and/or propanediol.

Suitable alkoxylated glycols which can be used herein are according to the formula R—(A)n-R1-OH wherein R is H, OH, a linear saturated or unsaturated alkyl of from 1 to 20 carbon atoms, preferably from 2 to 15 and more preferably from 2 to 10, wherein R1 is H or a linear saturated or unsaturated alkyl of from 1 to 20 carbon atoms, preferably from 2 to 15 and more preferably from 2 to 10, and A is an alkoxy group preferably ethoxy, methoxy, and/or propoxy and n is from 1 to 5, preferably 1 to 2. Suitable alkoxylated glycols to be used herein are methoxy octadecanol and/or ethoxyethoxyethanol.

Suitable alkoxylated aromatic alcohols which can be used herein are according to the formula $R(A)_n$—OH wherein R is an alkyl substituted or non-alkyl substituted aryl group of from 1 to 20 carbon atoms, preferably from 2 to 15 and more preferably from 2 to 10, wherein A is an alkoxy group preferably butoxy, propoxy and/or ethoxy, and n is an integer of from 1 to 5, preferably 1 to 2. Suitable alkoxylated aromatic alcohols are benzoxyethanol and/or benzoxypropanol.

Suitable aromatic alcohols which can be used herein are according to the formula R—OH wherein R is an alkyl substituted or non-alkyl substituted aryl group of from 1 to 20 carbon atoms, preferably from 1 to 15 and more preferably from 1 to 10. For example a suitable aromatic alcohol to be used herein is benzyl alcohol.

Suitable aliphatic branched alcohols which can be used herein are according to the formula R—OH wherein R is a branched saturated or unsaturated alkyl group of from 1 to 20 carbon atoms, preferably from 2 to 15 and more preferably from 5 to 12. Particularly suitable aliphatic branched alcohols to be used herein include 2-ethylbutanol and/or 2-methylbutanol.

Suitable alkoxylated aliphatic branched alcohols which can be used herein are according to the formula $R(A)_n$—OH wherein R is a branched saturated or unsaturated alkyl group of from 1 to 20 carbon atoms, preferably from 2 to 15 and more preferably from 5 to 12, wherein A is an alkoxy group preferably butoxy, propoxy and/or ethoxy, and n is an integer of from 1 to 5, preferably 1 to 2. Suitable alkoxylated aliphatic branched alcohols include 1-methylpropoxyethanol and/or 2-methylbutoxyethanol.

Suitable alkoxylated linear C1–C5 alcohols which can be used herein are according to the formula $R(A)_n$—OH wherein R is a linear saturated or unsaturated alkyl group of from 1 to 5 carbon atoms, preferably from 2 to 4, wherein A is an alkoxy group preferably butoxy, propoxy and/or ethoxy, and n is an integer of from 1 to 5, preferably 1 to 2. Suitable alkoxylated aliphatic linear C1–C5 alcohols are butoxy propoxy propanol (n-BPP), butoxyethanol, butoxypropanol, ethoxyethanol or mixtures thereof. Butoxy propoxy propanol is commercially available under the trade name n-BPP® from Dow chemical.

Suitable linear C1–C5 alcohols which can be used herein are according to the formula R—OH wherein R is a linear saturated or unsaturated alkyl group of from 1 to 5 carbon atoms, preferably from 2 to 4. Suitable linear C1–C5 alcohols are methanol, ethanol, propanol or mixtures thereof.

Other suitable solvents include, but are not limited to, butyl diglycol ether (BDGE), butyltriglycol ether, ter amilic alcohol and the like. Particularly preferred solvents which can be used herein are butoxy propoxy propanol, butyl diglycol ether, benzyl alcohol, butoxypropanol, ethanol, methanol, isopropanol and mixtures thereof.

Typically, the compositions used in the methods of the present invention preferably comprise up to 20% by weight of the total composition of a solvent or mixtures thereof, more preferably from 0.5% to 10%, even more preferably from 3% to 10%. and even more preferably still from 1% to 8%, by weight.

Other suitable solvents for use herein include propylene glycol derivatives such as n-butoxypropanol or n-butoxypropoxypropanol, water-soluble CARBITOL $^R$ solvents or water-soluble CELLOSOLVE $^R$ solvents; water-soluble CARBITOL $^R$ solvents are compounds of the 2-(2-alkoxyethoxy)ethanol class wherein the alkoxy group is derived from ethyl, propyl or butyl; a preferred water-soluble carbitol is 2-(2-butoxyethoxy)ethanol also known as butyl carbitol. Water-soluble CELLOSOLVE $^R$ solvents are compounds of the 2-alkoxyethoxy ethanol class, with 2-butoxyethoxyethanol being preferred. Other suitable solvents include benzyl alcohol, and diols such as 2-ethyl-1,3-hexanediol and 2,2,4-trimethyl-1,3-pentanediol and mixtures thereof. Some preferred solvents for use herein are n-butoxypropoxypropanol, BUTYL CARBITOL® and mixtures thereof.

The solvents can also be selected from the group of compounds comprising ether derivatives of mono-, di- and tri-ethylene glycol, propylene glycol, butylene glycol ethers, and mixtures thereof. The molecular weights of these solvents are preferably less than 350, more preferably between 100 and 300, even more preferably between 115 and 250. Examples of preferred solvents include, for example, monoethylene glycol n-hexyl ether, mono-propylene glycol n-butyl ether, and tri-propylene glycol methyl ether. Ethylene glycol and propylene glycol ethers are commercially available from the Dow Chemical Company under the tradename "Dowanol" and from the Arco Chemical Company under the tradename "Arcosolv". Other preferred solvents including mono- and di-ethylene glycol n-hexyl ether are available from the Union Carbide company.

Hydrophobic Solvent

In order to improve cleaning in liquid compositions, one can use a hydrophobic solvent that has cleaning activity. The hydrophobic solvents which may be employed in the hard surface cleaning compositions herein can be any of the well-known "degreasing" solvents commonly used in, for example, the dry cleaning industry, in the hard surface cleaner industry and the metalworking industry.

A useful definition of such solvents can be derived from the solubility parameters as set forth in "The Hoy," a publication of Union Carbide, incorporated herein by reference. The most useful parameter appears to be the hydrogen bonding parameter which is calculated by the formula:

$$\gamma H = \gamma T\left[\frac{a-1}{a}\right]^{1/2}$$

wherein γH is the hydrogen bonding parameter, a is the aggregation number, $$\left(\mathrm{Log}\,\alpha = 3.39066\ T_b/T_c - 0.15848 - \mathrm{Log}\,\frac{M}{d}\right), \text{ and}$$

γT is the solubility parameter which is obtained from the formula:

$$\gamma T = \left[\frac{(\Delta H_{25} - RT)d}{M}\right]^{1/2}$$

where $\Delta H_{25}$ is the heat of vaporization at 25° C., R is the gas constant (1.987 cal/mole/°), T is the absolute temperature in ° K., $T_b$ is the boiling point in ° K., $T_c$ is the critical temperature in ° K., d is the density in g/ml, and M is the molecular weight.

For the compositions herein, hydrogen bonding parameters are preferably less than 7.7, more preferably from 2 to 7, or 7.7, and even more preferably from 3 to 6. Solvents with lower numbers become increasingly difficult to solubilize in the compositions and have a greater tendency to cause a haze on glass. Higher numbers require more solvent to provide good greasy/oily soil cleaning.

Hydrophobic solvents are typically used, when present, at a level of from 0.5% to 30%, preferably from 2% to 15%, more preferably from 3% to 8%. Dilute compositions typically have solvents at a level of from 1% to 10%, preferably from 3% to 6%. Concentrated compositions contain from 10% to 30%, preferably from 10% to 20% of solvent.

Many of such solvents comprise hydrocarbon or halogenated hydrocarbon moieties of the alkyl or cycloalkyl type, and have a boiling point well above room temperature, i.e., above 20° C.

One highly preferred solvent is limonene, which not only has good grease removal but also a pleasant odor properties.

The formulator of compositions of the present type will be guided in the selection of solvent partly by the need to provide good grease-cutting properties, and partly by aesthetic considerations. For example, kerosene hydrocarbons function quite well for grease cutting in the present compositions, but can be malodorous. Kerosene must be exceptionally clean before it can be used, even in commercial situations. For home use, where malodors would not be tolerated, the formulator would be more likely to select solvents which have a relatively pleasant odor, or odors which can be reasonably modified by perfuming.

The $C_6$–$C_9$ alkyl aromatic solvents, especially the $C_6$–$C_9$ alkyl benzenes, preferably octyl benzene, exhibit excellent grease removal properties and have a low, pleasant odor. Likewise, the olefin solvents having a boiling point of at least 100° C., especially alpha-olefins, preferably 1-decene or 1-dodecene, are excellent grease removal solvents.

Generically, glycol ethers useful herein have the formula $R^{11}$ O—($R^{12}$O-)$_m$1H wherein each $R^{11}$ is an alkyl group which contains from 3 to 8 carbon atoms, each $R^{12}$ is either ethylene or propylene, and $m^1$ is a number from 1 to 3. The most preferred glycol ethers are selected from the group consisting of monopropyleneglycolmonopropyl ether, dipropyleneglycolmonobutyl ether, monopropyleneglycolmonobutyl ether, ethyleneglycolmonohexyl ether, ethyleneglycolmonobutyl ether, diethyleneglycolmonohexyl ether, monoethyleneglycolmonohexyl ether, monoethyleneglycolmonobutyl ether, and mixtures thereof.

A particularly preferred type of solvent for these hard surface cleaner compositions comprises diols having from 6 to 16 carbon atoms in their molecular structure. Preferred diol solvents have a solubility in water of from 0.1 to 20 g/100 g of water at 20° C. The diol solvents in addition to good grease cutting ability, impart to the compositions an enhanced ability to remove calcium soap soils from surfaces such as bathtub and shower stall walls. These soils are particularly difficult to remove, especially for compositions which do not contain an abrasive. Other solvents such as benzyl alcohol, n-hexanol, and phthalic acid esters of $C_{1-4}$ alcohols can also be used.

Solvents such as pine oil, orange terpene, benzyl alcohol, n-hexanol, phthalic acid esters of $C_{1-4}$ alcohols, butoxy propanol, Butyl Carbitol® and 1(2-n-butoxy-1-methylethoxy)propane-2-ol (also called butoxy propoxy propanol or dipropylene glycol monobutyl ether), hexyl diglycol (Hexyl Carbitol®), butyl triglycol, diols such as 2,2,4-trimethyl-1,3-pentanediol, and mixtures thereof, can be used. The butoxy-propanol solvent should have no more than 20%, preferably no more than 10%, more preferably no more than 7%, of the secondary isomer in which the butoxy group is attached to the secondary atom of the propanol for improved odor.

The level of hydrophobic solvent is preferably, when present, from 1% to 15%, more preferably from 2% to 12%, even more preferably from 5% to 10%.

Hydrotropes

The compositions used in the methods of the present invention may optionally comprise one or more materials which are hydrotropes. Hydrotropes suitable for use in the compositions herein include the $C_1$–$C_3$ alkyl aryl sulfonates, $C_6$–$C_{12}$ alkanols, $C_1$–$C_6$ carboxylic sulfates and sulfonates, urea, $C_1$–$C_6$ hydrocarboxylates, $C_1$–$C_4$ carboxylates, $C_2$–$C_4$ organic diacids and mixtures of these hydrotrope materials. The composition of the present invention preferably comprises from 0.5% to 8%, by weight of the liquid detergent composition of a hydrotrope selected from alkali metal and calcium xylene and toluene sulfonates.

Suitable $C_1$–$C_3$ alkyl aryl sulfonates include sodium, potassium, calcium and ammonium xylene sulfonates; sodium, potassium, calcium and ammonium toluene sulfonates; sodium, potassium, calcium and ammonium cumene sulfonates; and sodium, potassium, calcium and ammonium substituted or unsubstituted naphthalene sulfonates and mixtures thereof.

Suitable $C_1$–$C_8$ carboxylic sulfate or sulfonate salts are any water soluble salts or organic compounds comprising 1 to 8 carbon atoms (exclusive of substituent groups), which are substituted with sulfate or sulfonate and have at least one carboxylic group. The substituted organic compound may be cyclic, acylic or aromatic, i.e. benzene derivatives. Preferred alkyl compounds have from 1 to 4 carbon atoms substituted with sulfate or sulfonate and have from 1 to 2 carboxylic groups. Examples of this type of hydrotrope include sulfosuccinate salts, sulfophthalic salts, sulfoacetic salts, m-sulfobenzoic acid salts and diester sulfosuccinates, preferably the sodium or potassium salts as disclosed in U.S. Pat. No. 3,915,903.

Suitable $C_1$–$C_4$ hydrocarboxylates and $C_1$–$C_4$ carboxylates for use herein include acetates and propionates and citrates. Suitable $C_2$–$C_4$ diacids for use herein include succinic, glutaric and adipic acids.

Other compounds which deliver hydrotropic effects suitable for use herein as a hydrotrope include $C_6$–$C_{12}$ alkanols and urea.

Preferred hydrotropes for use herein are sodium, potassium, calcium and ammonium cumene sulfonate; sodium, potassium, calcium and ammonium xylene sulfonate; sodium, potassium, calcium and ammonium toluene sulfonate and mixtures thereof. Most preferred are sodium cumene sulfonate and calcium xylene sulfonate and mixtures thereof. These preferred hydrotrope materials can be present in the composition to the extent of from 0.5% to 8% by weight.

Chelating Agents—The compositions used herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein.

Amino phosphonates are also suitable for use as chelating agents in the compositions of the invention when at lease low levels of total phosphorus are permitted in detergent compositions, and include ethylenediaminetetrakis (methylenephosphonates) as DEQUEST. Preferred, these amino phosphonates to not contain alkyl or alkenyl groups with more than 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

The compositions herein may also contain water-soluble methyl glycine diacetic acid (MGDA) salts (or acid form) as a chelant or co-builder. Similarly, the so called "weak" builders such as citrate can also be used as chelating agents.

Other suitable chelating agents include bicine/bis(2-ethanol)glycine), N-(2-hydroxylethyl) iminodiacetic acid (HIDA), N-(2,3-dihydroxy-propyl) diethanolamine, 1,2-diamino-2-propanol N,N'-tetramethyl-1,3-diamino-2-propanol, N,N-bis(2-hydroxyethyl)glycine (a.k.a. bicine), and N-tris (hydroxymethyl)methyl glycine (a.k.a. tricine) are also preferred. Mixtures of any of the above are acceptable.

If utilized, these chelating agents will preferably comprise from 0.1% to 15% by weight of the compositions herein. More preferably, if utilized, the chelating agents will comprise from 0.1% to 3.0% by weight of such compositions.

Surfactants.

The compositions used in the methods according to the present invention may optionally contain surfactants, preferably selected from: anionic surfactants, cationic surfactants; nonionic surfactants; amphoteric surfactants; and zwitterionic surfactants. It is preferred that the surfactant when used be "short" chain length surfactants. That is, the hydrophobic portion of the molecule should typically contain from 7 to 12 carbon atoms. This however, does not exclude the use of longer chain surfactants, either alone or in combination with short chain surfactants, in the compositions used in the methods of the present invention.

A wide range of these surfactants can be used in the compositions used in the methods of the present invention. A typical listing of anionic, nonionic, ampholytic and zwitterionic classes, and species of these surfactants, is given in U.S. Pat. No. 3,664,961 issued to Norris on May 23, 1972 and in "Surface Active Agents and Detergents" (Vol. I and II by Schwartz, Perry and Berch). Amphoteric surfactants are also described in detail in "Amphoteric Surfactants, Second Edition", E. G. Lomax, Editor (published 1996, by Marcel Dekker, Inc.)

Anionic Surfactant Component

The compositions herein can optionally contain from 5% to 40% of an anionic surfactant component. More preferably the anionic surfactant component comprises from 15% to 35% of the compositions used herein.

The anionic surfactant component preferably comprises alkyl sulfates and alkyl ether sulfates derived from conventional alcohol sources, e.g., natural alcohols, synthetic alcohols such as those sold under the trade name of NEODOL™, ALFOL™, LIAL™, LUTENSOL™ and the like. Alkyl ether sulfates are also known as alkyl polyethoxylate sulfates. These ethoxylated alkyl sulfates are those which correspond to the formula:

$$R'—O—(C_2H_4O)_nSO_3M$$

wherein R' is a $C_8$–$C_{18}$ alkyl group, n is from 0.01 to 6, and M is a salt-forming cation. Preferably, R' is $C_{10-16}$ alkyl, n is from 0.01 to 4, and M is sodium, potassium, ammonium, alkylammonium, or alkanolammonium. Most preferably, R' is $C_{12}$–$C_{16}$, n is from 0.01 to 3 and M is sodium. The alkyl ether sulfates will generally be used in the form of mixtures comprising varying R' chain lengths and varying degrees of ethoxylation. Frequently such mixtures will inevitably also contain some unethoxylated alkyl sulfate materials, i.e., surfactants of the above ethoxylated alkyl sulfate formula wherein n=0.

Other anionic surfactants useful for detersive purposes can also be included in the compositions used herein. These can include salts (including, for example, sodium, potassium, ammonium, and substituted ammonium salts such as mono-, di- and triethanolamine salts) of soap, $C_9$–$C_{15}$ linear alkylbenzenesulphonates, $C_8$–$C_{22}$ primary or secondary alkanesulphonates, $C_8$–$C_{22}$ olefin sulphonates, sulphonated polycarboxylic acids prepared by sulphonation of the pyrolyzed product of alkaline earth metal citrates, e.g., as described in British patent specification No. 1,082,179, $C_{8-22}$ alkyl glycerol sulfonates, fatty acyl glycerol sulfonates, fatty oleyl glycerol sulfates, $C_{11-16}$ secondary soaps, alkyl phenol ethylene oxide ether sulfates, paraffin sulfonates, alkyl phosphates, isethionates such as the acyl isethionates, N-acyl taurates, fatty acid amides of methyl tauride, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates, sulfates of alkylpolysaccharides such as the sulfates of alkylpolyglucoside (the nonionic nonsulfated compounds being described below), branched primary alkyl sulfates, $C_{12-16}$ alkyl polyalkoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation, and fatty acids esterified with isethionic acid and neutralized with sodium hydroxide. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

One type of anionic surfactant which can be utilized encompasses alkyl ester sulfonates. These are desirable because they can be made with renewable, non-petroleum resources. Preparation of the alkyl ester sulfonate surfactant component can be effected according to known methods disclosed in the technical literature. For instance, linear esters of $C_8$–$C_{20}$ carboxylic acids can be sulfonated with gaseous $SO_3$ according to "The Journal of the American Oil Chemists Society," 52 (1975), pp. 323–329. Suitable starting materials would include natural fatty substances as derived from tallow, palm, and coconut oils, etc. Suitable salts include metal salts such as sodium, potassium, and lithium salts, and substituted or unsubstituted ammonium salts, such as methyl-, dimethyl, -trimethyl, and quaternary ammonium cations, e.g. tetramethyl-ammonium and dimethyl piperdinium, and cations derived from alkanolamines, e.g. monoethanol-amine, diethanolamine, and triethanolamine. Especially preferred are the methyl ester sulfonates wherein the alkyl group is $C_{12}$–$C_{16}$.

Other suitable anionic surfactant can be found in U.S. Pat. Nos. 2,220,099 2,477,383, 2,486,921, 2,486,922 2,396,278, 3,332,880, 4,557,853, and 3,929,678 incorporated herein by reference. Commercial sources of such surfactants can be found in McCutcheon's EMULSIFIERS AND DETERGENTS, North American Edition, 1997, McCutcheon Division, MC Publishing Company, also incorporated herein by reference.

Nonionic Surfactants

The compositions used herein can also contain from 3% to 10% of a certain type of nonionic surfactant component. More preferably, the nonionic surfactant component will comprise from 4% to 6% of the compositions used herein. Suitable nonionic detergent surfactants are generally disclosed in U.S. Pat. No. 3,929,678, Laughlin et al., issued Dec. 30, 1975, at column 13, line 14 through column 16, line 6, incorporated herein by reference. Exemplary, non-limiting classes of useful nonionic surfactants include: alkyl dialkyl amine oxide, alkyl ethoxylate, alkanoyl glucose amide, alkyl betaines, and mixtures thereof.

One type of nonionic surfactant which is present in the compositions herein comprises the $C_8$–$C_{18}$, preferably $C_{10}$–$C_{16}$, polyhydroxy fatty acid amides. These materials are more fully described in Pan/Gosselink; U.S. Pat. No. 5,332,528; Issued Jul. 26, 1994, which is incorporated herein by reference. These polyhydroxy fatty acid amides have a general structure of the formula:

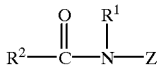

wherein $R^1$ is H, $C_1$–$C_4$ hydrocarbyl, 2-hydroxyethyl, 2-hydroxypropyl, or a mixture thereof; $R^2$ is $C_8$–$C_{18}$ hydrocarbyl; and Z is a polyhydroxyhydrocarbyl having a linear hydrocarbyl chain with at least 3 hydroxyls directly connected to the chain, or an alkoxylated derivative thereof. Examples of such surfactants include the $C_{10}$–$C_{18}$ N-methyl, or N-hydroxypropyl, glucamides. The N-propyl through N-hexyl $C_{12}$–$C_{16}$ glucamides can be used for lower sudsing performance. Polyhydroxy fatty acid amides will preferably comprise from 1% to 5% of the compositions used herein.

In the nonionic surfactant component of the compositions used herein, the polyhydroxy fatty acid amides hereinbefore described may be combined with certain other types of nonionic surfactants. These other types include ethoxylated alcohols and ethylene oxide-propylene oxide block co-polymer surfactants, as well as combinations of these nonionic surfactant types.

Other nonionic surfactants for use herein include, but are not limited to: the polyethylene, polypropylene, and polybutylene oxide condensates of alkyl phenols. In general, the polyethylene oxide condensates are preferred. These compounds include the condensation products of alkyl phenols having an alkyl group containing from 6 to 12 carbon atoms in either a straight chain or branched chain configuration with the alkylene oxide. In a preferred embodiment, the ethylene oxide is present in an amount equal to from 5 to 25 moles of ethylene oxide per mole of alkyl phenol. Commercially available nonionic surfactants of this type include Igepal® CO-630, marketed by the GAF Corporation; and Triton® X-45, X-114, X-100, and X-102, all marketed by the Rohm & Haas Company. These compounds are commonly referred to as alkyl phenol alkoxylates, (e.g., alkyl phenol ethoxylates).

Ethoxylated alcohol surfactant materials useful in the nonionic surfactant component herein are those which correspond to the general formula:

$$R^1—O—(C_2H_4O)_nH$$

wherein $R^1$ is a $C_8$–$C_{18}$ alkyl group and n ranges from 5 to 15. Preferably $R^1$ is an alkyl group, which may be primary or secondary, that contains from 9 to 15 carbon atoms, more preferably from 9 to 12 carbon atoms. Preferably the ethoxylated fatty alcohols will contain from 2 to 12 ethylene oxide moieties per molecule, more preferably from 8 to 12 ethylene oxide moieties per molecule. The ethoxylated fatty alcohol nonionic surfactant will frequently have a hydrophilic-lipophilic balance (HLB) which ranges from 6 to 15, most preferably from 10 to 15.

Examples of fatty alcohol ethoxylates useful as the nonionic surfactant component of the compositions herein will include those which are made from alcohols of 12 to 15 carbon atoms and which contain 7 moles of ethylene oxide. Such materials have been commercially marketed under the tradenames Neodol 25-7 and Neodol 23-6.5 by Shell Chemical Company. Other useful Neodols include Neodol 1-5, ethoxylated fatty alcohol averaging 11 carbon atoms in its alkyl chain with 5 moles of ethylene oxide; Neodol 23-9, an ethoxylated primary $C_{12}$–$C_{13}$ alcohol having 9 moles of ethylene oxide and Neodol 91-10, an ethoxylated $C_9$–$C_{11}$ primary alcohol having 10 moles of ethylene oxide. Alcohol ethoxylates of this type have also been marketed by Shell Chemical Company under the Dobanol tradename. Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles of ethylene oxide per mole of fatty alcohol.

Other examples of suitable ethoxylated alcohol nonionic surfactants include Tergitol 15-S-7 and Tergitol 15-S-9, both of which are secondary alcohol ethoxylates that have been commercially marketed by Union Carbide Corporation. The former is a mixed ethoxylation product of $C_{11}$ to $C_{15}$ linear secondary alkanol with 7 moles of ethylene oxide and the latter is a similar product but with 9 moles of ethylene oxide being reacted.

Other types of alcohol ethoxylate nonionics useful in the present compositions are higher molecular weight nonionics, such as Neodol 45-11, which are similar ethylene oxide condensation products of higher fatty alcohols, with the higher fatty alcohol being of 14–15 carbon atoms and the number of ethylene oxide groups per mole being 11. Such products have also been commercially marketed by Shell Chemical Company.

Ethoxylated alcohol nonionic surfactants, when present, will frequently comprise from 0.2% to 4% of the compositions herein. More preferably, such ethoxylated alcohols will comprise from 0.5% to 1.5% of the compositions.

Another type of nonionic surfactant suitable for use in combination with the nonionic surfactant component herein comprises the ethylene oxide-propylene oxide block co-polymers that function as polymeric surfactants. Such block co-polymers comprise one or more groups which are hydrophobic and which contain mostly ethylene oxide moieties and one or more hydrophobic groups which contain mostly propylene oxide moieties. Such groups are attached to the residue of a compound that contained one or more hydroxy groups or amine groups. Such polymeric surfactants have a molecular weight ranging from 400 to 60,000.

Preferred ethylene oxide-propylene oxide polymeric surfactants are those in which propylene oxide is condensed with an amine, especially a diamine, to provide a base that is then condensed with ethylene oxide. Materials of this type are marketed under the tradename Tetronic®. Similar structures wherein the ethylene diamine is replaced with a polyol such as propylene glycol are marketed under the tradename "Pluronic®". Preferred ethylene oxide-propylene oxide (EO-PO) polymeric surfactants have an HLB which ranges from 4 to 30, more preferably 10 to 20.

The ethylene oxide-propylene oxide block co-polymers used herein are described in greater detail in Pancheri/Mao; U.S. Pat. No. 5,167,872; Issued Dec. 2, 1992. This patent is incorporated herein by reference.

Ethylene oxide-propylene oxide block co-polymers will frequently be present to the extent of from 0.1% to 2% of the compositions herein. More preferably, these polymeric surfactant materials will comprise from 0.2% to 0.8% of the compositions herein.

Alkylpolysaccharides disclosed in U.S. Pat. No. 4,565,647, Llenado, issued Jan. 21, 1986, having a hydrophobic group containing from 6 to 30 carbon atoms, preferably from 10 to 16 carbon atoms and a polysaccharide, e.g., a polyglycoside, hydrophilic group containing from 1.3 to 10, preferably from 1.3 to 3, most preferably from 1.3 to 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Optionally, and less desirably, there can be a polyalkylene-oxide chain joining the hydrophobic moiety and the polysaccharide moiety. The preferred alkyleneoxide is ethylene oxide. Typical hydrophobic groups include alkyl groups, either saturated or unsaturated, branched or unbranched containing from 8 to 18, preferably from 10 to 16, carbon atoms. Preferably, the alkyl group is a straight chain saturated alkyl group. The alkyl group can contain up to 3 hydroxy groups and/or the polyalkyleneoxide chain can contain up to 10, preferably less than 5, alkyleneoxide moieties. Suitable alkyl polysaccharides are octyl, nonyl, decyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexa-glucosides.

The preferred alkylpolyglycosides have the formula $$R^2O(C_nH_{2n}O)_t(\text{glycosyl})_x$$

wherein $R^2$ is selected from the group consisting of alkyl, alkyl-phenyl, hydroxyalkyl, hydroxyalkylphenyl, and mixtures thereof in which the alkyl groups contain from 10 to 18, preferably from 12 to 14, carbon atoms; n is 2 or 3, preferably 2; t is from 0 to 10, preferably 0; and x is from 1.3 to 10, preferably from 1.3 to 3, most preferably from 1.3 to 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position.

Other suitable nonionic surfactant can be found in U.S. Pat. Nos. 4,565,647, 3,929,678 and 4,557,853 incorporated by reference herein. Commercial sources of such surfactants can be found in McCutcheon's EMULSIFIERS AND DETERGENTS, North American Edition, 1997, McCutcheon Division, MC Publishing Company, also incorporated herein by reference.

iii) Cationic;

Cationic surfactants suitable for use in the compositions used in the methods of the present invention include those having a long-chain hydrocarbyl group. Examples of such cationic surfactants include the ammonium surfactants such as alkyldimethylammonium halogenides, and those surfactants having the formula:

$$[R^2(OR^3)_y][R^4(OR^3)_y]_2R^5N^+X^-$$

wherein $R^2$ is an alkyl or alkyl benzyl group having from 8 to 18 carbon atoms in the alkyl chain, each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, —$CH_2CHOH$—$CHOHCOR^6CHOHCH_2OH$ wherein $R^6$ is any hexose or hexose polymer having a molecular weight less than 1000, and hydrogen when y is not 0; $R^5$ is the same as $R^4$ or is an alkyl chain wherein the total number of carbon atoms of $R^2$ plus $R^5$ is not more than 18; each y is from 0 to 10 and the sum of the y values is from 0 to 15; and X is any compatible anion.

Examples of suitable cationic surfactants are described in following documents, all of which are incorporated by reference herein in their entirety: M.C. Publishing Co., McCutcheon's, Detergents & Emulsifiers, (North American edition 1997); Schwartz, et al., Surface Active Agents, Their Chemistry and Technology, New York: Interscience Publishers, 1949; U.S. Pat. Nos. 3,155,591, 3,929,678, 3,959,461, 4,387,090 and 4,228,044.

Examples of suitable cationic surfactants are those corresponding to the general formula:

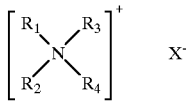

wherein $R_1$, $R_2$, $R_3$, and $R_4$ are independently selected from an aliphatic group of from 1 to 22 carbon atoms or an aromatic, alkoxy, polyoxyalkylene, alkylamido, hydroxyalkyl, aryl or alkylaryl group having up to 22 carbon atoms; and X is a salt-forming anion such as those selected from halogen, (e.g. chloride, bromide), acetate, citrate, lactate, glycolate, phosphate nitrate, sulfate, and alkylsulfate radicals. The aliphatic groups can contain, in addition to carbon and hydrogen atoms, ether linkages, and other groups such as amino groups. The longer chain aliphatic groups, e.g., those of 12 carbons, or higher, can be saturated or unsaturated. Preferred is when $R_1$, $R_2$, $R_3$, and $R_4$ are independently selected from C1 to C22 alkyl. Especially preferred are cationic materials containing two long alkyl chains and two short alkyl chains or those containing one long alkyl chain and three short alkyl chains. The long alkyl chains in the compounds described in the previous sentence have from 12 to 22 carbon atoms, preferably from 16 to 22 carbon atoms, and the short alkyl chains in the compounds described in the previous sentence have from 1 to 3 carbon atoms, preferably from 1 to 2 carbon atoms.

iv) Ampohteric; (Non-zwitterionic)

These surfactants are similar to the zwitterionic surfactants, but without the quaternary group. However, they contain an amine group that is protonated at the low pH of the composition (below pH 5.5), to form a cationic group, and they may also possess an anionic group at these pHs. Amphoteric surfactants can be used in the compositions used in the methods of the present invention.

Amphoteric and ampholytic surfactants which can be either cationic or anionic depending upon the pH of the system are represented by surfactants such as dodecylbetaalanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol", and described in U.S. Pat. No. 2,528,378, said patents being incorporated herein by reference.

Additional amphoteric surfactants can be found in U.S. Pat. No. 3,929,678 and listings of their commercial sources can be found in McCutcheon's Detergents and Emulsifiers, North American Ed. 1997, both of which are incorporated herein by reference.

Other suitable amphoteric surfactants include the amine oxides corresponding to the formula:

$$RR'R''N\rightarrow O$$

wherein R is a primary alkyl group containing 6–24 carbons, preferably 10–18 carbons, and wherein R' and R" are, each, independently, an alkyl group containing 1 to 6 carbon atoms. The arrow in the formula is a conventional representation of a semi-polar bond. The preferred amine oxides are those in which the primary alkyl group has a straight chain in at least most of the molecules, generally at least 70%, preferably at least 90% of the molecules, and the amine oxides which are especially preferred are those in which R contains 10–18 carbons and R' and R" are both methyl. Exemplary of the preferred amine oxides are the N-hexyldimethylamine oxide, N-octyldimethylamine oxide, N-decyldimethylamine oxide, N-dodecyl dimethylamine oxide, N-tetradecyldimethylamine oxide, N-hexadecyl dimethylamine oxide, N-octadecyldimethylamine oxide, N-eicosyldimethylamine oxide, N-docosyldimethylamine oxide, N-tetracosyl dimethylamine oxide, the corresponding amine oxides in which one or both of the methyl groups are replaced with ethyl or 2-hydroxyethyl groups and mixtures thereof. A most preferred amine oxide for use herein is N-decyldimethylamine oxide.

Other suitable amphoteric surfactants for the purpose of the invention are the phosphine or sulfoxide surfactants of formula:

$$RR'R''A\rightarrow O$$

wherein A is phosphorus or sulfur atom, R is a primary alkyl group containing 6–24 carbons, preferably 10–18 carbons, and wherein R' and R" are, each, independently selected from methyl, ethyl and 2-hydroxyethyl. The arrow in the formula is a conventional representation of a semi-polar bond.

The compositions used herein may optionally contain from 0.001% to 1%, preferably from 0.01% to 0.5%, more preferably from 0.02% to 0.2%, and even more preferably from 0.03% to 0.08%, of $C_{6-10}$ short chain amphocarboxylate surfactant. It has been found that these amphocarboxylate, and, especially glycinate, surfactants provide good cleaning with superior filming/streaking for hard surface cleaning compositions that are used to clean both glass and/or relatively hard-to-remove soils. Despite the short chain, the detergency is good and the short chains provide improved filming/streaking, even as compared to most of the zwitterionic surfactants described hereinafter. Depending upon the level of cleaning desired and/or the amount of hydrophobic material in the composition that needs to be solubilized, one can either use only the amphocarboxylate surfactant, or can combine it with other surfactant, preferably zwitterionic surfactants.

The "amphocarboxylate" surfactants herein preferably have the generic formula:

$$RN(R^1)(CH_2)_nN(R^2)(CH_2)_pC(O)OM$$

wherein R is a $C_{6-10}$ hydrophobic moiety, typically a fatty acyl moiety containing from 6 to 10 carbon atoms which, in combination with the nitrogen atom forms an amido group, $R^1$ is hydrogen (preferably) or a $C_{1-2}$ alkyl group, $R^2$ is a $C_{1-3}$ alkyl or, substituted $C_{1-3}$ alkyl, e.g., hydroxy substituted or carboxy methoxy substituted, preferably, hydroxy ethyl, each n is an integer from 1 to 3, each p is an integer from 1 to 2, preferably 1, and each M is a water-soluble cation, typically an alkali metal, ammonium, and/or alkanolammonium cation. Such surfactants are available, for example: from Witco under the trade name Rewoteric AM-V®, having the formula $$C_7H_{15}C(O)NH(CH_2)_2N(CH_2CH_2OH)CH_2C(O)O^{(-)}Na^{(+)};$$

Mona Industries, under the trade name Monateric 1000®, having the formula $$C_7H_{15}C(O)NH(CH_2)_2N(CH_2CH_2OH)CH_2CH_2C(O)O^{(-)}Na^{(+)};$$

and Lonza under the trade name Amphoterge KJ-2®, having the formula $$C_{7,9}H_{15,19}C(O)NH(CH_2)_2N(CH_2CH_2OCH_2C(O)O^{(-)}Na^{(+)})CH_2C(O)O^{(-)}Na^{(+)}.$$

One suitable amphoteric surfactant is a $C_{8-14}$ amidoalkylene glycinate surfactant. These surfactants are essentially cationic at the acid pH.

The glycinate surfactants herein preferably have the generic formula, as an acid, of:

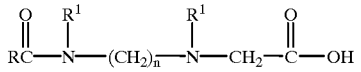

wherein

RC(O) is a $C_{8-14}$, preferably $C_{8-10}$, hydrophobic fatty acyl moiety containing from 8 to 14, preferably from 8 to 10, carbon atoms which, in combination with the nitrogen atom, forms an amido group, each n is from 1 to 3, and each $R^1$ is hydrogen (preferably) or a $C_{1-2}$ alkyl or hydroxy alkyl group. Such surfactants are available, e.g., in the salt form, for example, from Sherex under the trade name Rewoteric AM-V, having the formula:

$$C_7C(O)NH(CH_2)_2N(CH_2CH_2OH)CH_2C(O)O^{(-)}Na^{(+)}.$$

Not all amphoteric surfactants are acceptable. Longer chain glycinates and similar substituted amino propionates provide a much lower level of cleaning. Such propionates are available as, e.g., salts from Mona Industries, under the trade name Monateric 1000, having the formula:

$$C_7C(O)NH(CH_2)_2N(CH_2CH_2OH)CH_2CH_2C(O)O^{(-)}Na^{(+)}.$$

Cocoyl amido ethyleneamine-N-(hydroxyethyl)-2-hydroxypropyl-1-sulfonate (Miranol CS); $C_{8-10}$ fatty acyl amidoethyleneamine-N-(methyl)ethyl sulfonate; and analogs and homologs thereof, as their water-soluble salts, or acids, are amphoterics that are suitable. Optionally, these amphoterics may be combined with short chain nonionic surfactants to minimize sudsing.

Examples of other suitable amphoteric (non-zwitterionic) surfactants include:

cocoylamido ethyleneamine-N-(methyl)-acetates;

cocoylamido ethyleneamine-N-(hydroxyethyl)-acetates;

cocoylamido propyl amine-N-(hydroxyethyl)-acetates; and analogs and homologs thereof, as their water-soluble salts, or acids, are suitable.

Amphoteric surfactants suitable for use in the compositions used in the present methods include the derivatives of aliphatic secondary and tertiary amines in which the aliphatic radical is straight or branched and one of the aliphatic substituents contains from 8 to 18 carbon atoms and one contains an anionic water solubilizing group, e.g., carboxy, sulfonate, sulfate, phosphate, or phosphonate.

v) Zwitterionic:

The level of zwitterionic surfactant, when present in the compositions used in the methods of the present invention, is typically from 0.02% to 15%, preferably from 0.02% to 5%%, more preferably from 0.05 to 4%.

Some suitable zwitterionic surfactants which can be used herein comprise the betaine and betaine-like surfactants wherein the molecule contains both basic and acidic groups which form an inner salt giving the molecule both cationic and anionic hydrophilic groups over a broad range of pH values. Some common examples of these s are described in U.S. Pat. Nos. 2,082,275, 2,702,279 and 2,255,082, incorporated herein by reference. One of the preferred zwitterionic compounds have the formula

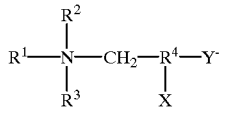

wherein R1 is an alkyl radical containing from 8 to 22 carbon atoms, R2 and R3 contain from 1 to 3 carbon atoms, R4 is an alkylene chain containing from 1 to 3 carbon atoms, X is selected from the group consisting of hydrogen and a hydroxyl radical, Y is selected from the group consisting of carboxyl and sulfonyl radicals and wherein the sum of R1, R2 and R3 radicals is from 14 to 24 carbon atoms.

Zwitterionic surfactants, as mentioned hereinbefore, contain both a cationic group and an anionic group and are in substantial electrical neutrality where the number of anionic charges and cationic charges on the surfactant molecule are substantially the same. Zwitterionics, which typically contain both a quaternary ammonium group and an anionic group selected from sulfonate and carboxylate groups are desirable since they maintain their amphoteric character over most of the pH range of interest for cleaning hard surfaces. The sulfonate group is the preferred anionic group.

Preferred zwitterionic surfactants have the generic formula:

$$R^3—[C(O)—N(R^4)—(CR^5{}_2)_n1]_mN(R^6)_2{}^{(+)}—(CR^5{}_2)_p1—Y^{(-)}$$

wherein each Y is preferably a carboxylate ($COO^-$) or sulfonate ($SO_3^-$) group, more preferably sulfonate; wherein each $R^3$ is a hydrocarbon, e.g., an alkyl, or alkylene, group containing from 8 to 20, preferably from 10 to 18, more preferably from 12 to 16 carbon atoms; wherein each ($R^4$) is either hydrogen, or a short chain alkyl, or substituted alkyl, containing from one to four carbon atoms, preferably groups selected from the group consisting of methyl, ethyl, propyl, hydroxy substituted ethyl or propyl and mixtures thereof, preferably methyl; wherein each ($R^5$) is selected from the group consisting of hydrogen and hydroxy groups with no more than one hydroxy group in any $(CR^5{}_2)p^1$ group; wherein ($R^6$) is like $R^4$ except preferably not hydrogen; wherein m is 0 or 1; and wherein each $n^1$ and $p^1$ are an integer from 1 to 4, preferably from 2 to 3, more preferably 3. The $R^3$ groups can be branched, unsaturated, or both and such structures can provide filming/streaking benefits, even when used as part of a mixture with straight chain alkyl $R^3$ groups. The $R^4$ groups can also be connected to form ring structures such as imidazoline, pyridine, etc. Preferred hydrocarbyl amidoalkylene sulfobetaine (HASB) surfactants wherein m=1 and Y is a sulfonate group provide superior grease soil removal and/or filming/streaking and/or "anti-fogging" and/or perfume solubilization properties. Such hydrocarbylamidoalkylene sulfobetaines, and, to a lesser extent hydrocarbylamidoalkylene betaines are excellent for use in hard surface cleaning compositions, especially those formulated for use on both glass and hard-to-remove soils. They are even better when used with monoethanolamine and/or specific beta-amino alkanol as disclosed herein.

A specific surfactant is a $C_{10-14}$ fatty acylamidopropylene (hydroxypropylene)sulfobetaine, e.g., the surfactant available from the Witco Company as a 40% active product under the trade name "REWOTERIC AM CAS Sulfobetaine®."

Other zwitterionic surfactants are set forth at Col. 4 of U.S. Pat. No. 4 287,080, Siklosi, incorporated herein by reference. Other detailed listings of suitable zwitterionic surfactants for the compositions used herein can be found in U.S. Pat. Nos. 4,557,853 and 3,929,678 both of which are incorporated by reference herein. Commercial sources of such surfactants can be found in McCutcheon's EMULSIFIERS AND DETERGENTS, North American Edition, 1997, McCutcheon Division, MC Publishing Company, also incorporated herein by reference.

Another preferred zwitterionic surfactants is:

$$R—N^{(+)}(R^2)(R^3)R^4X^{(-)}$$

wherein R is a hydrophobic group; $R^2$ and $R^3$ are each $C_{1-4}$ alkyl, hydroxy alkyl or other substituted alkyl group which can also be joined to form ring structures with the N; $R^4$ is a moiety joining the cationic nitrogen atom to the hydrophilic group and is typically an alkylene, hydroxy alkylene, or polyalkoxy group containing from one to four carbon atoms; and X is the hydrophilic group which is preferably a carboxylate or sulfonate group.

Preferred hydrophobic groups R are alkyl groups containing from 8 to 22, preferably less than 18, more preferably less than 16, carbon atoms. The hydrophobic group can contain unsaturation and/or substituents and/or linking groups such as aryl groups, amido groups, ester groups, etc. In general, the simple alkyl groups are preferred for cost and stability reasons.

A specific "simple" zwitterionic surfactant is 3-(N-dodecyl-N,N-dimethyl)-2-hydroxy-propane-1-sulfonate, available from the Sherex Company under the trade name "Varion HC."

Other specific zwitterionic surfactants have the generic formula:

$$R—C(O)—N(R^2)—(CR^3{}_2)_n—N(R^2)_2{}^{(+)}—(CR^3{}_2)_n—SO_2{}^{(-)}$$

wherein each R is a hydrocarbon, e.g., an alkyl group containing from 8 up to 20, preferably up to 18, more preferably up to 16 carbon atoms, each ($R^2$) is either a hydrogen (when attached to the amido nitrogen), short chain alkyl or substituted alkyl containing from one to four carbon atoms, preferably groups selected from the group consisting of methyl, ethyl, propyl, hydroxy substituted ethyl or propyl and mixtures thereof, preferably methyl, each ($R^3$) is selected from the group consisting of hydrogen and hydroxy groups, and each n is a number from 1 to 4, preferably from 2 to 3; more preferably 3, with no more than one hydroxy group in any ($CR^3_2$) moiety. The R groups can be branched and/or unsaturated, and such structures can provide spotting/filming benefits, even when used as part of a mixture with straight chain alkyl R groups. The $R^2$ groups can also be connected to form ring structures. A surfactant of this type is a $C_{10-14}$ fatty acylamidopropylene(hydroxypropylene) sulfobetaine that is available from the Sherex Company under the trade name "Varion CAS Sulfobetaine".

Other zwitterionic surfactants useful, and, surprisingly, preferred, herein include hydrocarbyl, e.g., fatty, amidoalkylenebetaines (hereinafter also referred to as "HAB"). These surfactants, which are more cationic at the pH of the composition, have the generic formula:

$$R—C(O)—N(R^2)—(CR^3_2)_n—N(R^2)_2^{(+)}—(CR^3_2)_n—C(O)O^{(-)}$$

wherein each R is a hydrocarbon, e.g., an alkyl group containing from 8 up to 20, preferably up to 18, more preferably up to 16 carbon atoms, each ($R^2$) is either a hydrogen (when attached to the amido nitrogen), short chain alkyl or substituted alkyl containing from one to four carbon atoms, preferably groups selected from the group consisting of methyl, ethyl, propyl, hydroxy substituted ethyl or propyl and mixtures thereof, preferably methyl, each ($R^3$) is selected from the group consisting of hydrogen and hydroxy groups, and each n is a number from 1 to 4, preferably from 2 to 3; more preferably 3, with no more than one hydroxy group in any ($CR^3_2$) moiety. The R groups can be branched and/or unsaturated, and such structures can provide spotting/filming benefits, even when used as part of a mixture with straight chain alkyl R groups.

An example of such a surfactant is a $C_{10-14}$ fatty acylamidopropylenebetaine available from the Miranol Company under the trade name "Miratine CB."

Polyhydroxy Fatty Acid Amide Surfactant—The compositions used in the methods of the present invention may also contain an effective amount of polyhydroxy fatty acid amide surfactant. By "effective amount" is meant that the formulator of the composition can select an amount of polyhydroxy fatty acid amide to be incorporated into the compositions that will improve the performance of the composition.

The compositions herein will typically comprise, when present 1% weight basis, polyhydroxy fatty acid amide surfactant, more preferably from 3% to 30%, of the polyhydroxy fatty acid amide. The polyhydroxy fatty acid amide surfactant component comprises compounds of the structural formula:

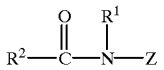

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{15}$ alkyl or alkenyl, or mixtures thereof, and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z will be a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, and alkoxylated derivatives thereof, where n is an integer from 3 to 5, inclusive, and R' is H or a cyclic or aliphatic monosaccharide. Most preferred are glycityls wherein n is 4, particularly $—CH_2—(CHOH)_4—CH_2OH$.

R' can be, for example, N-methyl, N-ethyl, N-propyl, N-isopropyl, N-butyl, N-2-hydroxy ethyl, or N-2-hydroxy propyl.

$R^2$—CO—N<can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, by Thomas Hedley & Co., Ltd., U.S. Pat. No. 2,965,576, issued Dec. 20, 1960 to E. R. Wilson, and U.S. Pat. No. 2,703,798, Anthony M. Schwartz, issued Mar. 8, 1955, and U.S. Pat. No. 1,985,424, issued Dec. 25, 1934 to Piggott, each of which is incorporated herein by reference.

Suds Boosters/Stabilizers

The compositions used herein can further include from 2% to 8%, preferably from 3% to 6%, of a suds booster or stabilizer component such as betaine surfactants, fatty acid alkanol amides, amine oxide semi-polar nonionic surfactants, and $C_{8-22}$ alkyl polyglycosides. Combinations of these suds boosters/stabilizers can also be used.

Betaine surfactants useful as suds boosters herein have the general formula:

$$R^{(+)}—N(R^1)_2—R^2COO^{(-)}$$

wherein R is a hydrophobic group selected from alkyl groups containing from 10 to 22 carbon atoms, preferably from 12 to 18 carbon atoms, alkyl aryl and aryl alkyl groups containing a similar number of carbon atoms with a benzene ring being treated as equivalent to 2 carbon atoms, and similar structures interrupted by amino or ether linkages; each $R^1$ is an alkyl group containing from 1 to 3 carbon atoms; and $R^2$ is an alkylene group containing from 1 to 6 carbon atoms.

Examples of preferred betaines are dodecyl dimethyl betaine, cetyl dimethyl betaine, dodecyl amidopropyldimethyl betaine, tetradecyldimethyl betaine, tetradecylamidopropyldimethyl betaine, and dodecyldimethylammonium hexanoate. Other suitable amidoalkylbetaines are disclosed in U.S. Pat. Nos. 3,950,417; 4,137,191; and 4,375,421; and British Patent GB No. 2,103,236, all of which are incorporated herein by reference.

Alkanol amide surfactants useful as suds boosters herein include the ammonia, monoethanol, and diethanol amides of fatty acids having an acyl moiety containing from 8 to 18 carbon atoms. These materials are represented by the formula:

$$R_1—CO—N(H)_{m-1}(R_2OH)_{3-m}$$

wherein $R_1$ is a saturated or unsaturated, hydroxy-free aliphatic hydrocarbon group having from 7 to 21, preferably from 11 to 17 carbon atoms; $R_2$ represents a methylene or ethylene group; and m is 1, 2, or 3, preferably 1. Specific examples of such amides are monoethanol amine coconut fatty acid amide and diethanolamine dodecyl fatty acid amide. These acyl moieties may be derived from naturally occurring glycerides, e.g., coconut oil, palm oil, soybean oil, and tallow, but can be derived synthetically, e.g., by the oxidation of petroleum or by hydrogenation of carbon monoxide by the Fischer-Tropsch process. The monoethanolamides and diethanolamides of $C_{12-14}$ fatty acids are preferred.

Amine oxide semi-polar nonionic surfactants useful as suds boosters/stabilizers comprise compounds and mixtures of compounds having the formula:

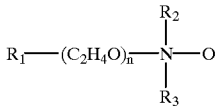

wherein $R_1$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms, $R_2$ and $R_3$ are each methyl, ethyl, propyl, isopropyl, 2-hydroxyethyl, 2-hydroxypropyl, or 3-hydroxypropyl, and n is from 0 to 10. Particularly preferred are amine oxides of the formula:

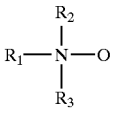

wherein $R_1$ is a $C_{12-16}$ alkyl and $R_2$ and $R_3$ are methyl or ethyl. The above hydroxy-free amides, and amine oxides are more fully described in U.S. Pat. No. 4,316,824, incorporated herein by reference.

Other surfactants suitable for use as suds boosters/stabilizers in the compositions herein are the nonionic fatty alkylpolyglycosides. Such materials have the formula:

$$R_2O(C_nH_{2n}O)_y(Z)_x$$

wherein Z is derived from glucose, R is a hydrophobic group selected from alkyl, alkylphenyl, hydroxyalkylphenyl, and mixtures thereof in which said alkyl groups contain from 8 to 22, preferably from 12 to 14 carbon atoms; n is 2 or 3 preferably 2, y is from 0 to 10, preferably 0; and x is from 1.5 to 8, preferably from 1.5 to 4, most preferably from 1.6 to 2.7. U.S. Pat. Nos. 4,393,203 and 4,732,704, incorporated herein by reference, describe these alkyl polyglycoside surfactants.

Builder

The compositions used in accordance with the methods of the present invention may contain a builder system. Any conventional builder system is suitable for use herein including aluminosilicate materials, silicates, polycarboxylates and fatty acids, materials such as ethylene-diamine tetraacetate, metal ion sequestrants such as aminopolyphosphonates, particularly ethylenediamine tetramethylene phosphonic acid and diethylene triamine pentamethylene-phosphonic acid. Though less preferred for obvious environmental reasons, phosphate builders can also be used herein.

Suitable polycarboxylates builders for use herein include citric acid, preferably in the form of a water-soluble salt, derivatives of succinic acid of the formula R—CH(COOH) CH2(COOH) wherein R is C10–20 alkyl or alkenyl, preferably C12–16, or wherein R can be substituted with hydroxyl, sulfo sulfoxyl or sulfone substituents. Specific examples include lauryl succinate, myristyl succinate, palmityl succinate 2-dodecenylsuccinate, 2-tetradecenyl succinate. Succinate builders are preferably used in the form of their water-soluble salts, including sodium, potassium, ammonium and alkanolammonium salts.

Other suitable polycarboxylates are oxodisuccinates and mixtures of tartrate monosuccinic and tartrate disuccinic acid such as described in U.S. Pat. No. 4,663,071.

Citrates such as citric acid and soluble salts thereof (particularly sodium salt), are polycarboxylate builders of particular importance due to their availability from renewable resources and their biodegradability. Oxydisuccinates are also especially useful in the methods of the present invention.

Especially for the liquid execution herein, suitable fatty acid builders for use herein are saturated or unsaturated C10–18 fatty acids, as well as the corresponding soaps. Preferred saturated species have from 12 to 16 carbon atoms in the alkyl chain. The preferred unsaturated fatty acid is oleic acid. Other preferred builder system for liquid compositions is based on dodecenyl succinic acid and citric acid.

Builder are preferably included in amounts of from 1% to 30% by weight of the composition more preferably from 1% to 30% and even more preferably from 1% to 15% by weight.

Optional Ingredients

The compositions for use in the methods of the present invention may optionally include conventional hard surface cleaning additives. These conventional additives will be, when present, typically in amounts of from 0.001% to 99.9%, by weight.

Aqueous Liquid Carrier

The compositions used herein may preferably contain from 30% to 95% of an aqueous liquid carrier in which the essential and optional compositions components are dissolved, dispersed or suspended. More preferably the aqueous liquid carrier will comprise from 50% to 65% of the compositions herein.

One essential component of the aqueous liquid carrier is, of course, water. The aqueous liquid carrier, however, may contain other materials which are liquid, or which dissolve in the liquid carrier, at room temperature and which may also serve some other function besides that of a simple filler. Such materials can include, for example, hydrotropes and solvents.

Bleach;

The compositions herein may also comprise a bleaching component. Any bleach known to those skilled in the art may be suitable to be used herein including any peroxygen bleach as well as a chlorine releasing component.

Suitable peroxygen bleaches for use herein include hydrogen peroxide or sources thereof. As used herein a source of hydrogen peroxide refers to any compound which produces active oxygen when said compound is in contact with water. Suitable water-soluble sources of hydrogen peroxide for use herein include percarbonates, preformed percarboxylic acids, persilicates, persulphates, perborates, organic and inorganic peroxides and/or hydroperoxides.

Suitable chlorine releasing component for use herein is an alkali metal hypochlorite. Advantageously, the composition of the invention are stable in presence of this bleaching component. Although alkali metal hypochlorites are preferred, other hypochlorite compounds may also be used herein and can be selected from calcium and magnesium hypochlorite. A preferred alkali metal hypochlorite for use herein is sodium hypochlorite.

The compositions used in the methods of the present invention that comprise a peroxygen bleach may further comprise a bleach activator or mixtures thereof. By "bleach activator", it is meant herein a compound which reacts with peroxygen bleach like hydrogen peroxide to form a peracid. The peracid thus formed constitutes the activated bleach. Suitable bleach activators which can be used herein include those belonging to the class of esters, amides, imides, or anhydrides. Examples of suitable compounds of this type are disclosed in British Patent GB 1 586 769 and GB 2 143 231 and a method for their formation into a prilled form is described in European Published Patent Application EP-A-62 523. Suitable examples of such compounds to be used herein are tetracetyl ethylene diamine (TAED), sodium 3,5,5 trimethyl hexanoyloxybenzene sulphonate, diperoxy dodecanoic acid as described for instance in U.S. Pat. No. 4,818,425 and nonylamide of peroxyadipic acid as described for instance in U.S. Pat. No. 4,259,201 and n-nonanoyloxybenzenesulphonate (NOBS). Also suitable are N-acyl caprolactams selected from the group consisting of substituted or unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particular family of bleach activators of interest was disclosed in EP 624 154, and particularly preferred in that family is acetyl triethyl citrate (ATC). Acetyl triethyl citrate has the advantage that it is environmental-friendly as it eventually degrades into citric acid and alcohol. Furthermore, acetyl triethyl citrate has a good hydrolytical stability in the product upon storage and it is an efficient bleach activator. Finally, it provides good building capacity to the composition.

The source of active oxygen according to the present invention acts as an oxidizing agent, it increases the ability of the compositions to remove colored stains and organic stains in general, to destroy malodorous molecules and to kill germs. Suitable sources of active oxygen are hydrogen peroxide or sources thereof. As used herein a hydrogen peroxide source refers to any compound which produces hydrogen peroxide when said compound is in contact with water. Suitable water-soluble inorganic sources of hydrogen peroxide for use herein include persulfate salts (i.e., dipersulfate and monopersulfate salts), persulfuric acid, percarbonates, metal peroxides, perborates and persilicate salts.

In addition, other classes of peroxides can be used as an alternative to hydrogen peroxide and sources thereof or in combination with hydrogen peroxide and sources thereof. Suitable classes include dialkylperoxides, diacylperoxide, performed percarboxylic acids, organic and inorganic peroxides and/or hydroperoxides. Suitable organic peroxides/hydroperoxides include diacyl and dialkyl peroxides/hydroperoxides such as dibenzoyl peroxide, t-butyl hydroperoxide, dilauroyl peroxide, dicumyl peroxide, and mixtures thereof. Suitable preformed peroxyacids for use in the compositions according to the present invention include diperoxydodecandioic acid DPDA, magnesium perphthalic acid, perlauric acid, perbenzoic acid, diperoxyazelaic acid and mixtures thereof.

Persulfate salts, or mixtures thereof, are the preferred sources of active oxygen to be used in the compositions according to the present invention. Preferred persulfate salt to be used herein is the monopersulfate triple salt. One example of monopersulfate salt commercially available is potassium monopersulfate commercialized by Peroxide Chemie GMBH under the trade name Curox®, by Degussa under the trade name Caroat and from Du Pont under the trade name Oxone. Other persulfate salts such as dipersulfate salts commercially available from Peroxide Chemie GMBH can be used in the compositions according to the present invention.

Additionally, the compositions used in the methods of the present invention can also include bleach catalysts, such as the transition metal bleach, particularly manganese and cobalt, catalysts. Examples of suitable bleach catalysts and complex ligands to complex with manganese to produce these bleach catalystsl, can be found disclosed in U.S. Pat. Nos. 5,246,621, 5,244,594, 4,430,243, 5,114,611, 4,728,455, 5,284,944, 5,246,612, 5,256,779, 5,280,117, 5,274,147, 5,153,161, 5,227,084, 5,194,416, and 5,114,606. Also in European patent applications 549,271A1, 549,272A1, 544,440A2 and 544,490A1.

The compositions used in the methods of the present invention may comprise up to 30% by weight of the total composition of a bleach, preferably from 0.1% to 30%, more preferably from 0.1% to 20%, and most preferably from 0.1% to 15%, by weight. Additionally, the compositions used in the methods of the present invention may comprise up to 30% by weight of the total composition of a bleach activator, preferably from 0.1% to 30%, more preferably from 0.1% to 20%, and most preferably from 0.1% to 15% by weight.

Thickener

The compositions used herein can also contain from 0.2% to 5% of a thickening agent. More preferably, such a thickener will comprise from 0.5% to 2.5% of the compositions herein. Thickeners are typically selected from the class of cellulose derivatives. Suitable thickeners include hydroxy ethyl cellulose, hydroxyethyl methyl cellulose, carboxy methyl cellulose, Quatrisoft LM200, and the like. A preferred thickening agent is hydroxypropyl methylcellulose.

The hydroxypropyl methylcellulose polymer has a number average molecular weight of 50,000 to 125,000 and a viscosity of a 2 wt. % aqueous solution at 25° C. (ADTMD2363) of 50,000 to 100,000 cps. An especially preferred hydroxypropyl cellulose polymer is Methocel® J75MS-N wherein a 2.0 wt. % aqueous solution at 25° C. has a viscosity of 75,000 cps. Especially preferred hydroxypropyl cellulose polymers are surface treated such that the hydroxypropyl cellulose polymer will ready disperse at 25° C. into an aqueous solution having a pH of at least 8.5.

When formulated the compositions used in the methods of the present invention, the hydroxypropyl methylcellulose polymer should impart to the detergent composition a Brookfield viscosity of from 500 to 3500 cps at 25° C. More preferably, the hydroxypropyl methylcellulose material will impart a viscosity of from 1000 to 3000 cps at 25° C. For purposes of this invention, viscosity is measured with a Brookfield LVTDV-11 viscometer apparatus using an RV #2 spindle at 12 rpm.

Calcium and/or Magnesium Ions

The presence of calcium and/or magnesium (divalent) ions improves the cleaning of greasy soils for various compositions, i.e., compositions containing alkyl ethoxy sulfates and/or polyhydroxy fatty acid amides. This is especially true when the compositions are used in softened water that contains few divalent ions. It is believed that calcium and/or magnesium ions increase the packing of the surfactants at the oil/water interface, thereby reducing interfacial tension and improving grease cleaning.

Compositions used in the methods of the present invention herein containing magnesium and/or calcium ions exhibit good grease removal, manifest mildness to the skin, and provide good storage stability. These ions can be present in the compositions used herein at an active level of from 0.1% to 4%, preferably from 0.3% to 3.5%, more preferably from 0.5% to 1%, by weight.

Preferably, the magnesium or calcium ions are added as a hydroxide, chloride, acetate, formate, oxide or nitrate salt to the compositions used in the methods of the present invention. Calcium ions may also be added as salts of the hydrotrope.

The amount of calcium or magnesium ions present in compositions used herein will be dependent upon the amount of total surfactant present therein. When calcium ions are present in the compositions used herein, the molar ratio of calcium ions to total anionic surfactant should be from 0.25:1 to 2:1.

Formulating such divalent ion-containing compositions in alkaline pH matrices may be difficult due to the incompatibility of the divalent ions, particularly magnesium, with hydroxide ions. When both divalent ions and alkaline pH are combined with the surfactant mixture of this invention, grease cleaning is achieved that is superior to that obtained by either alkaline pH or divalent ions alone. Yet, during storage, the stability of these compositions becomes poor due to the formation of hydroxide precipitates. Therefore, chelating agents discussed hereinafter may also be necessary.

Other Ingredients—A wide variety of other ingredients useful in compositions can be included in the compositions used herein, including other active ingredients, carriers, hydrotropes, antioxidants, processing aids, dyes or pigments, perfumes, solid fillers for bar compositions, etc.

An antioxidant can be optionally added to the detergent compositions of the present invention. They can be any conventional antioxidant used in detergent compositions, such as 2,6-di-tert-butyl-4-methylphenol (BHT), carbamate, ascorbate, thiosulfate, monoethanolamine (MEA), diethanolamine, triethanolamine, etc. It is preferred that the antioxidant, when present, be present in the composition from 0.001% to 5% by weight.

Method of Softening Soil

In one method soiled hard surfaces are contacted with a soil softening amount, typically from 0.5 ml. to 20 ml. preferably from 3 ml. to 10 ml., of the composition used in the methods of the present invention. The actual amount of composition used will be based on the judgment of user, and will typically depend upon factors such as the particular product formulation of the composition, including the concentration of active ingredient in the composition, the number of soiled hard surfaces to be cleaned, the degree of soiling on the hard surfaces, the type of hard surface which is soiled, and the like. The particular product formulation, in turn, will depend upon a number of factors, such as the intended market (i.e., U.S., Europe, Japan, etc.) for the composition product. The following are examples of typical methods in which the detergent compositions of the present invention may be used to clean dishes. These examples are for illustrative purposes and are not intended to be limiting.

Typically it is prefered that aqueous solutions of from 0.001% to about 1%, more preferably from 0.004% to 0.5%, even more preferably from 0.01% to 0.2% of a liquid detergent composition is used The soiled hard surfaces are immersed, either partially or totally in a the sink or basin containing the composition and water, where they are left for a time sufficient for the soil to soften, typically from 2 minutes to overnight. A cloth, sponge, or similar article which may be immersed in the composition and water mixture prior to being contacted with the hard surface, and is typically contacted with the hard surface for a period of time ranging from 1 to 10 seconds, although the actual time will vary with each application and user. The contacting of the cloth, sponge, or similar article to the hard surface is preferably accompanied by a concurrent scrubbing of the hard surface. This contact, with optional scrubbing removes the softened soil.

Another method used involves direct application of the detergent compositions used herein, either neat or diluted in a dispenser bottle, onto the soiled hard surface to be cleaned. This can be accomplished by using a device for absorbing the composition used, such as a sponge or dishrag, which is placed directly into a separate quantity of undiluted or somewhat diluted composition for a period of time typically ranging from 1 to 5 seconds. The absorbing device, and consequently the undiluted or somewhat diluted composition, can then be contacted individually with the surface of each of the soiled hard surface The soil is left alone for a time sufficient to soften, typically from 2 minutes to overnight. Then the absorbing device again contacts or alternatively contacting with a cloth, sponge, or similar article which is different to the absorbing device, the hard surface, preferably accompanied by concurrent scrubbing to remove the soften soil. Prior to contact and scrubbing, this method may involve immersing or rinsing the soiled dishes into a water bath without any of the composition used. Additionally, or instead of immersing or rinsing prior to contact, the hard surface can be rinsed under running water after scrubbing.

Another method used involves direct application of the detergent compositions used herein, either neat or diluted in a dispenser bottle, onto the soiled hard surface to be cleaned. This can be accomplished by applying the composition on to the soil by a spray dispenser, an aerosol or the like. The soil is left alone for a time sufficient to soften, typically from 2 minutes to overnight. A cloth, sponge, or similar article which may be immersed in the composition and water mixture prior to being contacted with the hard surface, and is typically contacted with the hard surface for a period of time ranging from 1 to 10 seconds, although the actual time will vary with each application and user. The contacting of the cloth, sponge, or similar article to the hard surface is preferably accompanied by a concurrent scrubbing of the hard surface. This contact, with optional scrubbing removes the softened soil. Prior to spraying and scrubbing, this method may involve immersing the soiled hard surfaces into a water bath without any composition used. Additionally, or instead of immersing or rinsing prior to contact, the hard surface can be rinsed under running water after scrubbing.

As previously mentioned, the composition used in the methods of the present invention can be in the form of a pretreatment formulation for automatic dishwashing. These compositions are for application before the hardsurfaces, e.g. tableware, pots & pans, etc., are cleaned in the automatic dishwasher. Application may be either before or after placement into the dishwasher. Typically, automatic dishwashing pretreaters will have water present at levels of preferably at least 60%, more preferably at least 70%, even more preferably 75%. The automatic dishwashing pretreaters will also preferably have an alkaline pH i.e. greater than 7. Typically, the automatic dishwashing pretreaters will additionally contain one or more of the following ingredients: enzymes (preferably proteases and/or amylases), alkalinity sources (e.g. sodium carbonate, sodium hydroxide), and solvents and hydrotropes (e.g. propylene glycol, low molecular weight polyethyleneglycols, sodium xylene sulfonate, sodium cumene sulfonate). It is additionally preferred that the automatic dishwashing pretreaters will be in the form of a viscous liquid, with a viscosity in the range of 500 to 10,000 cps, more preferably 700 to 7,000 cps. This high viscosity is preferably obtained by the use of a shear thinning thickening system typically be based on polyacrylates, modified polacrylates, clays or modified clays.

Composition Form and Preparation

The compositions used in the methods of the present invention may be in a wide variety of forms, including liquids, liquid-gels, pumpable spray, aerosol spray, mousse, foam, granule, powder or even impregnated into a sponge, cloth or scouring pad, such as steel wool.

The liquid, gel or suspension compositions which can be used herein may be prepared by combining the essential and optional ingredients together in any convenient order using suitable agitation to form a homogeneous product. Preferred methods for making detergent compositions of this type, and for preparing various components of such compositions, are described in greater detail in Ofosu-Asante: U.S. Pat. No. 5,474,710: Issued Dec. 12, 1995.

Accordingly, such materials, if present, are desirably protected in a particle such as that described in U.S. Pat. No. 4,652,392, Baginski et al.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10, DeGussa) is admixed with a proteolytic enzyme solution containing 3%–5% of $C_{13-15}$ ethoxylated alcohol (EO 7) nonionic surfactant. Typically, the enzyme/surfactant solution is 2.5× the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned enzymes, bleaches, bleach activators, bleach catalysts, photoactivators, dyes, fluorescers, and hydrolyzable surfactants can be "protected" for use in detergents, including liquid compositions.

Liquid compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to 6 carbon atoms and from 2 to 6 hydroxy groups (e.g., 1,3-propanediol, ethylene glycol, glycerine, and 1,2-propanediol) can also be used. The compositions may contain from 5% to 90%, typically 10% to 50% of such carriers.

An example of the procedure for making granules of the compositions used herein is as follows:—Linear aklylbenzenesulfonate, sodium tripolyphosphate, sodium silicate, sodium sulfate perfume, diamine and water are added to, heated and mixed via a crutcher. The resulting slurry is spray dried into a granular form.

An example of the procedure for making liquid compositions used herein is as follows:—To the free water, citrate and $MgCl_2$ are added and dissolved. To this solution amine oxide, betaine, ethanol, hydrotrope and nonionic surfactant are added. If free water isn't available, the $MgCl_2$ and citrate are added to the above mix then stirred until dissolved. At this point, maleic acid is added then followed by the diamine. AE×S is added last. In formulations without $Mg^{++}$ the procedure is the same.

Non-Aqueous Liquid Detergents

The manufacture of liquid detergent compositions which comprise a non-aqueous carrier medium can be prepared according to the disclosures of U.S. Pat. Nos. 4,753,570; 4,767,558; 4,772,413; 4,889,652; 4,892,673; GB-A-2,158,838; GB-A-2,195,125; GB-A-2,195,649; U.S. Pat. No. 4,988,462; U.S. Pat. No. 5,266,233; EP-A-225,654 (Jun. 16, 1987); EP-A-510,762 (Oct. 28, 1992); EP-A-540,089 (May 5,1993); EP-A-540,090 (May 5, 1993); U.S. Pat. No. 4,615,820; EP-A-565,017 (Oct. 13, 1993); EP-A-030,096 (Jun. 10, 1981), incorporated herein by reference. Such compositions can contain various particulate detersive ingredients (e.g., bleaching agents, as disclosed hereinabove) stably suspended therein. Such non-aqueous compositions thus comprise a LIQUID PHASE and, optionally a SOLID PHASE, all as described in the cited references.

The following examples are illustrative of the present invention, but are not meant to limit or otherwise define its scope. All parts, percentages and ratios used herein are expressed as percent weight unless otherwise specified.

In the following Examples all levels are quoted as % by weight of the composition.

EXAMPLES

Example I

Determination of Soil Removal (SR)

Starch soiled coupons are prepared according to the methods hereinbefore described. The coupons are tested according to the method hereinbefore defined to determine the Soil Removal. Twelve coupons were tested for each concentration of enzyme in a base light duty liquid detergent matrix of surfactants and water and the results were averaged and tabulated in Table I below. The low pH additive used in the method was an α-amylase enzyme having a specific activity at least 25% higher than the specific activity of Termamyl® at a temperature range of 25° C. to 55° C. and at a pH value in the range of 8 to 10, measured by the Phadebas® α-amylase activity assay, as described in PCT/DK96/00056. The results against concentration of enzyme in a light duty liquid detergent composition are tabulated as follows.

TABLE I

| Treatment amylase (ppm)* | % SR 20 min. soak in LDL |
|---|---|
| 0 | 7 |
| 1.20 | 71 |
| 0.24 | 65 |
| 0.12 | 54 |

*ppm: parts per million active enzyme.

Accordingly, as can be seen in Table I, the presence of a soil softening additive, namely enzyme, provides a significantly superior level of soil removal of starch based soils as opposed to a base matrix of water and surfactants which includes no soil softening additive.

Example II

The following liquid compositions are made:

| | A | B | C | D | E | F |
|---|---|---|---|---|---|---|
| pH 10% (q.s. to) | 9 | 10 | 10 | 9.3 | 8.5 | 11 |
| AS | 0 | 28 | 25 | 0 | 15 | 10 |
| AES | 30 | 0 | 0 | 20 | 0 | 0 |
| Amine Oxide | 5 | 3 | 7 | 5 | 15 | 12 |
| Betaine | 3 | 0 | 1 | 3 | 1 | 0 |
| Polyhydroxy fatty acid amide (C14) | 0 | 1.5 | 0 | 3 | 0 | 1 |
| AE nonionic | 2 | 0 | 4 | 0 | 0 | 20 |
| solvent | 5 | 0.01 | 0.5 | 0.1 | 0 | 0 |
| chelants | 0 | 0.5 | 2 | 0 | 0.2 | 3 |
| pH buffer | 1 | 5 | 7 | 1 | 5 | 7 |
| Mg++(as MgCl2) | 0.25 | 0 | 0 | 1 | 0 | 0 |
| Ca++(as CaXS)2) | 0 | 0 | 0 | 0 | 0.5 | 0 |
| builder | 0.25 | 0 | 0 | 0.7 | 0 | 0 |
| Protease | 0 | 0 | 0 | 0.01 | 0 | 0.05 |
| Amylase | 0 | 0 | 0 | 0 | 0.05 | 0.05 |
| Hydrotrope | 0 | 0 | 0 | 2 | 1.5 | 3 |
| Total (perfumes, dye, water, ethanol, etc.) | | | (q.s. to 100%) | | | |

| | G | H | I |
|---|---|---|---|
| pH 10% (q.s. to) | 6 | 8.5 | 7 |
| AES | 0 | 15 | 0.5 |
| Paraffin Sulfonate | 10 | 0.5 | 0.1 |
| Linear Alkyl Benzene Sulfonate | 20 | 0 | 0.01 |
| Betaine | 0 | 2 | 2 |
| Polyhydroxy fatty acid amide (C12) | 0 | 0 | 0.01 |
| AE nonionic | 2 | 10 | 0 |
| chelant | 0.2 | 0 | 0.1 |
| builder | 2 | 1 | 0.5 |
| Mg++(as MgCl2) | 0.01 | 0 | 0 |
| Ca++(as CaXS)2) | 0 | 0 | 0 |
| Protease | 0.001 | 0 | 0 |
| Amylase | 0.005 | 0 | 0 |
| lipase | 0.0001 | 0.0005 | |
| Hydrotrope | 0 | 0 | 5 |
| solvent | 0.1 | 0.5 | 10 |
| Total (perfumes, dye, water, ethanol, etc.) | | (to 100%) | |

The degree of ethoxylation in the AES ranges from 0.6 to 3.

The pH buffer is selected from diamines (such as dimethyl aminopropyl amine; 1,6-hexane diamine; 1,3 propane diamine; 2-methyl 1,5 pentane diamine; 1,3-pentanediamine; 1-methyl-diaminopropane) lysine, triethanolamine, di-ethanolamine, sodium carbonate, bicine, tricine and TRIS.

The amylase is selected from: Termamyl®, Fungamyl®; Duramyl®; BAN®, and the amylases as described in WO95/26397 and in co-pending application by Novo Nordisk PCT/DK96/00056.

The lipase is selected from: Amano-P; M1 Lipase®; Lipomax®; Lipolase®; D96L-lipolytic enzyme variant of the native lipase derived from *Humicola lanuginosa* as described in U.S. Ser. No. 08/341,826; and the *Humicola lanuginosa* strain DSM 4106.

The protease is selected from: Savinase®; Maxatase®; Maxacal®; Maxapem 15®; subtilisin BPN and BPN'; Protease B; Protease A; Protease D; Primase®; Durazym®; Opticlean®; and Optimase®; and Alcalase®.

Hydrotropes are selected from sodium, potassium, ammonium or water-soluble substituted ammonium salts of toluene sulfonic acid, naphthalene sulfonic acid, cumene sulfonic acid, xylene sulfonic acid.

The chelant is selected from: EDDS as described in U.S. Pat. No. 4,704,233, EDTA, DEQUEST, nitrilo-tri-acetates, and MGDA.

The builder is selected from: citric acid, citrate salts and mixtures thereof with citric acid, polycarboxylate builders selected from lauryl succinate, myristyl succinate, palmityl succinate 2-dodecenylsuccinate, 2-tetradecenyl succinate.

The solvent is selected from methanol, ethanol, propanol, limonene, BUTYL CARBITOL® and mixtures thereof.

Example III

| | A | B | C | D |
|---|---|---|---|---|
| pH 10% | 8.5 | 9 | 9.0 | 9.0 |
| AE0.6S | 0 | 0 | 0 | 0 |
| AE1S | 0 | 30 | 0 | 0 |
| AE1.4S | 30 | 0 | 27 | 0 |
| AE2.2S | 0 | 0 | 0 | 15 |
| Amine Oxide | 5 | 5 | 5 | 3 |
| Betaine | 3 | 3 | 0 | 0 |
| AE nonionic | 2 | 2 | 2 | 2 |
| pH buffer | 1 | 2 | 4 | 2 |
| Mg++(as MgCl2) | 0.25 | 0.25 | 0 | 0 |
| Ca++(as CaXS)2) | 0 | 0.4 | 0 | 0 |
| Total (perfumes, dye, water, ethanol, etc.) | | | (to 100%) | |

| | E | F | G | H | I | J |
|---|---|---|---|---|---|---|
| pH 10% | 9.3 | 8.5 | 11 | 10 | 9 | 9.2 |
| AS | 0 | 0 | 0 | 0 | 27 | 0 |
| AES | 0 | 15 | 10 | 27 | 0 | 20 |
| Paraffin Sulfonate | 20 | 0 | 0 | 0 | 0 | 0 |
| Linear Alkyl Benzene Sulfonate | 5 | 15 | 12 | 0 | 0 | 0 |
| Betaine | 3 | 1 | 0 | 2 | 2 | 0 |
| Amine Oxide | 0 | 0 | 0 | 2 | 5 | 7 |
| Polyhydroxy fatty acid amide (C12) | 3 | 0 | 1 | 2 | 0 | 0 |
| AE nonionic | 0 | 0 | 20 | 1 | 0 | 2 |
| Hydrotrope | 0 | 0 | 0 | 0 | 0 | 5 |
| pH buffer | 1 | 5 | 7 | 4 | 2 | 5 |
| Mg++(as MgCl2) | 1 | 0 | 0 | 0 | 0 | 0 |
| Ca++(as CaXS)2) | 0 | 0.5 | 0 | 0 | 0.1 | 0.1 |
| Protease | 0.1 | 0 | 0 | 0 | 0.06 | 0.1 |
| Amylase | 0 | 0.02 | 0 | 0.005 | 0 | 0.05 |
| Lipase | 0 | 0 | 0.025 | 0 | 0.05 | 0 |

-continued

| | | | | | | |
|---|---|---|---|---|---|---|
| chelant | 0 | 0.3 | 0 | 0 | 0.1 | 5.0 |
| builder | 0.65 | 0 | 0 | 10 | 0 | 0 |
| Total (perfumes, dye, water, ethanol, etc.) | | | (to 100%) | | | |

The pH buffer is selected from diamines (such as dimethyl aminopropyl amine; 1,6-hexane diamine; 1,3 propane diamine; 2-methyl 1,5 pentane diamine; 1,3-pentanediamine; 1-methyl-diaminopropane) lysine, tri-ethanolamine, di-ethanolamine, sodium carbonate, bicine, tricine and TRIS.

The amylase is selected from: Termamyl®, Fungamyl®; Duramyl®; BAN®, and the amylases as described in WO95/26397 and in co-pending application by Novo Nordisk PCT/DK96/00056.

The lipase is selected from: Amano-P; M1 Lipase®; Lipomax®; Lipolase®; D96L-lipolytic enzyme variant of the native lipase derived from *Humicola lanuginosa* as described in U.S. Ser. No. 08/341,826; and the *Humicola lanuginosa* strain DSM 4106.

The protease is selected from: Savinase®; Maxatase®; Maxacal®; Maxapem 15®; subtilisin BPN and BPN'; Protease B; Protease A; Protease D; Primase®; Durazym®; Opticlean®; and Optimase®; and Alcalase®.

Hydrotropes are selected from sodium, potassium, ammonium or water-soluble substituted ammonium salts of toluene sulfonic acid, naphthalene sulfonic acid, cumene sulfonic acid, xylene sulfonic acid.

The chelant is selected from: EDDS as described in U.S. Pat. No. 4,704,233, EDTA, DEQUEST, nitrilo-tri-acetates, and MGDA.

The builder is selected from: citric acid, citrate salts and mixtures thereof with citric acid, polycarboxylate builders selected from lauryl succinate, myristyl succinate, palmityl succinate 2-dodecenylsuccinate, 2-tetradecenyl succinate.

SEQUENCE LISTING

```
<160> NUMBER OF SEQ ID NOS: 1

<210> SEQ ID NO 1
<211> LENGTH: 20
<212> TYPE: PRT
<213> ORGANISM: Bacillus sp.

<400> SEQUENCE: 1

His His Asn Gly Thr Asn Gly Thr Met Met Gln Tyr Phe Glu Trp Tyr
1               5                   10                  15

Leu Pro Asn Asp
            20
```

What is claimed is:

1. A method for softening a soil in need of softening on a hard surface, comprising contacting said soil in need of softening, for a time sufficient to soften said soil in need of softening on said hard surface, with a soil softening amount of a composition comprising an enzyme and a high pH soil softening additive wherein said composition has a pH of greater than 8.5 to 12 and wherein further said composition has a Soil Softening Index of at least 15.

2. A method according to claim 1 wherein said high pH soil softening additive is selected from the group consisting of pH buffers, solvent, builders, chelants, surfactants and mixtures thereof.

3. A method according to claim 2, wherein said high pH soil softening additive is a pH buffer.

4. A method according to claim 2 wherein said high pH soil softening additive is a pH buffer, wherein said pH buffer is a low molecular weight organic diamine having a pK1 and a pK2, wherein the pK1 and a pK2 of said diamine are both in the range of from 8.0 to 11.5.

5. A method according to claim 4 wherein said pH buffer is a diamine selected from the group consisting of:

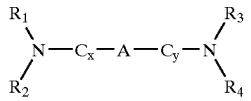

wherein $R_{1-4}$ are independently selected from H, methyl, ethyl, and ethylene oxides; $C_x$ and $C_y$ are independently selected from methylene groups or branched alkyl groups where x+y is from 3 to 6; and A is optionally present and is selected from electron donating or withdrawing moieties chosen to adjust the diamine pKa's to the desired range; wherein if A is present, then both x and y must be 2 or greater.

6. A method according to claim 2 wherein said solvent is selected from the group consisting of lower alcohols, limonene, butyl carbitol and mixtures thereof.

7. A method according to claim 1 wherein said hard surface is a tableware.

8. A method according to claim 1 wherein said enzyme is selected from the group consisting of protease, amylase, and mixtures thereof.

9. A method according to claim 1, wherein said enzyme is an α-amylase obtained from an alkalophilic Bacillus species, and comprises the following amino sequence in the N-terminal: His-His-Asn-Gly-Thr-Asn-Gly-Thr-Met-Met-Gln-Tyr-Phe-Glu-Trp-Tyr-Leu-Pro-Asn-Asp.

10. A method according to claim 1 wherein said hard surfaces on which said soil is deposited is partially or totally immersed in said composition.

11. A method for pre-treating a soil in need of softening on a hard surface, before cleaning in an automatic dishwasher, comprising contacting said soil in need of softening for a time sufficient to soften said soil in need of softening on said hard surface, with a soil softening amount of a composition comprising an enzyme and a high pH soil softening additive wherein said composition has a pH of greater than 8.5 to 12 and wherein further said composition has a Soil Softening Index of at least 15.

12. A method according to claim 11, wherein said high pH soil softening additive is selected from the group consisting of pH buffers, solvents, builders, chelants, surfactants and mixtures thereof.

13. A method according to of claim 12 wherein said hard surface is tableware.

14. A method according to claim 11 wherein said enzyme is selected from the group consisting of protease, amylase and mixtures thereof.

* * * * *